US010697419B2

(12) United States Patent
Tanaka et al.

(10) Patent No.: US 10,697,419 B2
(45) Date of Patent: Jun. 30, 2020

(54) IGNITION CONTROL APPARATUS

(71) Applicant: DENSO CORPORATION, Kariya, Aichi-pref. (JP)

(72) Inventors: Daisuke Tanaka, Nisshin (JP); Shota Kinoshita, Nisshin (JP); Noriaki Nishio, Nisshin (JP); Satoru Nakayama, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/079,120

(22) PCT Filed: Feb. 13, 2017

(86) PCT No.: PCT/JP2017/005187
§ 371 (c)(1),
(2) Date: Aug. 23, 2018

(87) PCT Pub. No.: WO2017/145846
PCT Pub. Date: Aug. 31, 2017

(65) Prior Publication Data

US 2019/0040835 A1 Feb. 7, 2019

(30) Foreign Application Priority Data

Feb. 24, 2016 (JP) ..... 2016-033536
May 26, 2016 (JP) ..... 2016-104830

(51) Int. Cl.
*F02P 3/05* (2006.01)
*F02P 15/00* (2006.01)
(Continued)

(52) U.S. Cl.
CPC ..... *F02P 3/051* (2013.01); *F02P 3/01* (2013.01); *F02P 9/002* (2013.01); *F02P 15/001* (2013.01);
(Continued)

(58) Field of Classification Search
CPC ... F02D 41/20; F02P 3/05; F02P 3/051; F02P 15/00; F02P 15/001; F02P 15/006; H01T 13/14; H01T 13/20
(Continued)

(56) References Cited

U.S. PATENT DOCUMENTS

2010/0206277 A1* 8/2010 Kajita ..... F02P 3/0846 123/620
2011/0106395 A1* 5/2011 Aida ..... F02P 3/04 701/102
(Continued)

FOREIGN PATENT DOCUMENTS

JP 2000-345951 12/2000
JP 2011-149406 8/2011
(Continued)

*Primary Examiner* — John Kwon
*Assistant Examiner* — Johnny H Hoang
(74) *Attorney, Agent, or Firm* — Nixon & Vanderhye PC

(57) ABSTRACT

An ignition control apparatus applied to an internal combustion engine including a spark plug includes an in-cylinder pressure acquisition section, a frequency signal transmitting section which transmits a frequency signal having a predetermined frequency to a switching element, and a weak discharge generating section which causes the frequency signal to be transmitted during an intake stroke and controls the frequency signal such that a weak discharge is generated at the spark plug a plurality of times. The weak discharge generating section controls the frequency signal so as to cause a duty ratio of the switching element to be changed in accordance with the in-cylinder pressure, such that the frequency of generating weak discharges during a time period in which the frequency signal is transmitted becomes higher than a predetermined frequency.

12 Claims, 12 Drawing Sheets

(51) Int. Cl.

| | |
|---|---|
| ***H01T 13/20*** | (2006.01) |
| ***F02P 9/00*** | (2006.01) |
| ***H01T 13/14*** | (2006.01) |
| ***F02P 15/10*** | (2006.01) |
| ***F02P 3/01*** | (2006.01) |
| *F02P 7/03* | (2006.01) |
| *F02P 17/12* | (2006.01) |
| *F02P 3/04* | (2006.01) |

(52) U.S. Cl.
CPC ..... *F02P 15/006* (2013.01); *F02P 15/10* (2013.01); *H01T 13/14* (2013.01); *H01T 13/20* (2013.01); *F02P 3/0442* (2013.01); *F02P 7/035* (2013.01); *F02P 9/007* (2013.01); *F02P 2017/121* (2013.01)

(58) Field of Classification Search
USPC ..... 123/143 A, 143 B, 143 R, 594, 620, 644
See application file for complete search history.

(56) References Cited

U.S. PATENT DOCUMENTS

| | | | | |
|---|---|---|---|---|
| 2012/0097140 | A1* | 4/2012 | Kusunoki ..... | F02P 9/002 123/620 |
| 2014/0261346 | A1* | 9/2014 | Tanaya ..... | F02P 3/02 123/594 |
| 2016/0138552 | A1* | 5/2016 | Itoi ..... | F02P 9/002 315/127 |
| 2016/0341170 | A1* | 11/2016 | Ota ..... | F01N 3/101 |

FOREIGN PATENT DOCUMENTS

| | | |
|---|---|---|
| JP | 2014-224493 | 12/2014 |
| JP | 2017-110497 | 6/2017 |
| JP | 2017-110498 | 6/2017 |

* cited by examiner

IGNITION CONTROL APPARATUS

CROSS-REFERENCE TO RELATED APPLICATIONS

This application is the U.S. national phase of International Application No. PCT/JP2017/005187 filed Feb. 13, 2017, which designated the U.S. and claims priority to Japanese Application No. 2016-033536 filed on Feb. 24, 2016 and Japanese Application No. 2016-104830 filed on May 26, 2016, the entire contents of each of which are hereby incorporated herein by reference.

TECHNICAL FIELD

The present disclosure relates to an ignition control apparatus which controls discharges of a spark plug.

BACKGROUND ART

A spark plug is installed in a cylinder of a gasoline engine, and an air-fuel mixture that is drawn into the cylinder is ignited by a spark discharge of a spark plug.

If the concentration of the air-fuel mixture that is drawn into the cylinder is high, and the air and fuel are not sufficiently mixed, then incomplete combustion will occur, thereby producing carbon. If this carbon adheres to the outer circumference of the center electrode of the spark plug, then at the next ignition, instead of a discharge occurring between the electrodes of the spark plug, a discharge (inner flying discharge) will occur between metal attachment fittings of the spark plug and the adhering carbon. As a result, since no discharge occurs between the electrodes of the spark plug, combustion of the air-fuel mixture cannot be achieved. This condition is referred to as smoldering. In this respect, with PTL 1, when the degree of advancement of the smoldering is large, multiple discharges are generated at timings when the pressure within the combustion chamber (hereinafter, referred to as in-cylinder pressure) is higher than the in-cylinder pressure at the time of ignition. In that way, even if the spark plug is in the smoldering state, the energy at the time of discharge (energy density) can be increased. The carbon adhering to the spark plug can thereby be efficiently burned off, and a self-cleaning function of the spark plug can be enhanced.

PRIOR ART LITERATURE

Patent Literature

[PTL 1] JP-A-2011-149406

SUMMARY OF THE INVENTION

However, there is a risk that wear of the electrodes of the spark plug may be promoted, as a result of producing multiple discharges between the electrodes of the spark plug in a condition in which the in-cylinder pressure is higher than that at the time of ignition, so that there will be a risk of shortening the life of the spark plug.

It is a main object of the present disclosure to overcome the above problem, a main objective of the disclosure being to provide an ignition control apparatus which can remove carbon adhering to a spark plug by supplying a relatively small amount of energy to the spark plug, and so suppress wear of the electrodes of the spark plug and consequently suppress a shortening of the life of the spark plug.

The present disclosure is of an ignition control apparatus that is applied to an internal combustion engine including a spark plug, which is caused by an induced voltage to generate a plasma discharge for igniting a combustible mixture in a combustion chamber, with the induced voltage being generated by conduction and blocking by a switching element provided in a drive circuit. The ignition control apparatus includes an in-cylinder pressure acquisition section that acquires a pressure in the combustion chamber as an in-cylinder pressure, a frequency signal transmitting section that transmits a frequency signal to the switching element, the frequency signal causing the switching element to repetitively perform conduction and blocking at a predetermined frequency, and a weak discharge generating section that causes the frequency signal transmitting section to transmit the frequency signal during an intake stroke and controls the frequency signal such that a weak discharge having a secondary current which is lower than that of the plasma discharge for igniting the combustible mixture is generated a plurality of times at the spark plug. The weak discharge generating section controls the frequency signal such that a duty ratio, which is a ratio of a conducting time period to a sum of the conducting time period and a blocking time period of the switching element, is changed in accordance with the in-cylinder pressure acquired by the in-cylinder pressure acquisition section, such that a frequency of generating the weak discharges generated at the spark plug becomes higher than a predetermined frequency during a time period in which the frequency signal is being transmitted.

If incomplete combustion of the fuel occurs, carbon may adhere to the electrodes of the spark plug, and a risk of so-called smoldering may arise. In the conventional art, multiple electrical discharges are generated at timings when the in-cylinder pressure becomes higher than that at the time of ignition, to burn off the carbon adhering to the spark plug. However, if multiple electrical discharges are generated in a condition in which the in-cylinder pressure is high, since the energy at the time of discharge is increased, this can lead to advancement of wear of the discharge electrodes of the spark plug, with a consequent risk of shortening the life thereof.

As a countermeasure against this, the present ignition control apparatus includes a weak discharge generating section. Weak discharges having a secondary current which is lower than that of a plasma discharge caused to be generated at the time of ignition are generated a plurality of times at the spark plug, through control of a frequency signal by the weak discharge generating section, the frequency signal being transmitted by a frequency signal transmitting section. As a result, carbon adhering to the discharge electrode of the spark plug can be burned off. At that time, the frequency signal is controlled so as to change a duty ratio, which is a ratio of a conduction time period to a sum of the conduction time period and a blocking time period of a switching element, in accordance with an in-cylinder pressure that is acquired by an in-cylinder pressure acquisition section, such that the frequency of generating the weak discharges at the spark plug becomes higher than a predetermined frequency during a time period in which the frequency signal is being transmitted. Hence, since the duty ratio is changed each time the in-cylinder pressure changes, the frequency of generating the weak discharges at the spark plug can be more reliably made higher than the predetermined frequency. The control of generating the weak discharges is performed by the weak discharge generating section during an intake stroke. Hence, since the weak discharges are generated under a condition in which the in-cylinder pressure in the combustion chamber is comparatively low, the secondary current required for generating the weak discharges can be held to a low value. Furthermore, since the weak discharges have a secondary current that is lower than that which flows in the spark plug during a plasma discharge for igniting a combustible mixture, the secondary current can be restrained to a greater degree than that in the conventional case in which multiple electrical discharges are generated. Consequently, wear of the electrodes of the spark plug and shortening of life thereof can be restrained.

BRIEF DESCRIPTION OF THE DRAWINGS

The above objective and other objectives, features and advantages of the present disclosure are described more clearly in the following detailed description, referring to the accompanying drawings. The drawings are as follows.

DESCRIPTION OF THE EMBODIMENTS

Figure 1:
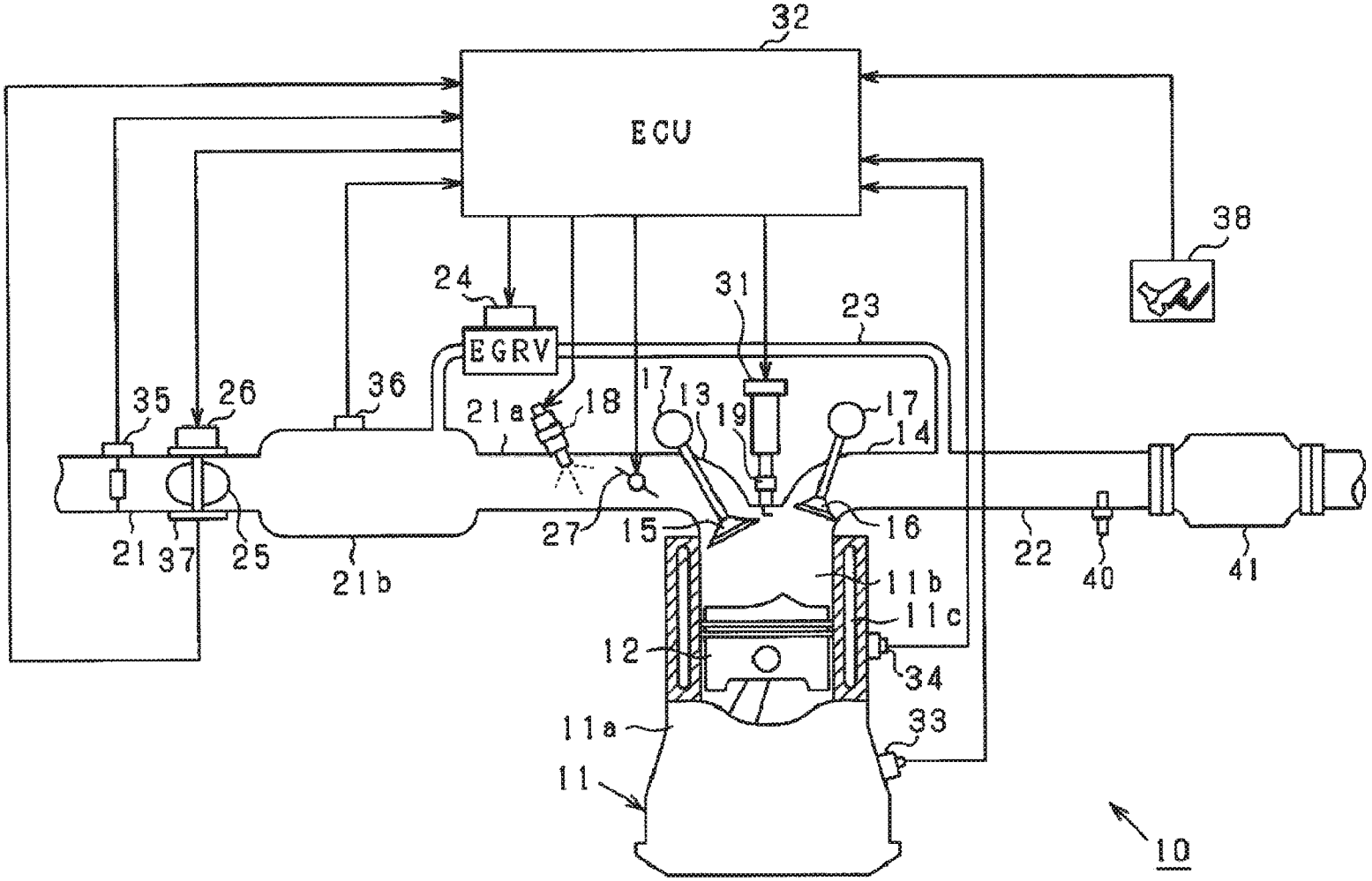
FIG. 1 is a schematic diagram of an internal combustion engine and a control apparatus of the same, according to a first embodiment.

Referring to FIG. 1, an engine system 10 includes an engine 11, which is a spark ignition type internal combustion engine. The engine system 10 controls changing of an air/fuel ratio of an air-fuel mixture, in accordance with the running condition of the engine 11, toward a rich side or a lean side with respect to a logical air/fuel ratio. For example, if the operating condition of the engine 11 is in an operation range of low speed of rotation and low load, the control changes the air/fuel ratio of the air-fuel mixture to the lean side.

A combustion chamber 11*b* and a water jacket 11*c* are formed in the interior of an engine block 11*a*, which configures a main part of the engine 11, of the engine 11. The engine block 11*a* is provided for accommodating a piston 12 while enabling reciprocating motion of the piston 12. The water jacket 11*c* is a space in which a liquid coolant (also known as coolant water) can flow, and is disposed so as to surround the periphery of the combustion chamber 11*b*.

A cylinder head, which is the upper part of the engine block 11*a*, is formed such as to enable communication between the combustion chamber 11*b*, and the intake port 13 and exhaust port 14. Furthermore, an intake valve 15 for controlling the communication state between the intake port 13 and the combustion chamber 11*b*, an exhaust valve 16 for controlling the communication state between the exhaust port 14 and the combustion chamber 11*b*, and a valve drive mechanism 17 for effecting opening and closing operations of the intake valve 15 and the exhaust valve 16 at predetermined timings are provided in the cylinder head.

An intake manifold 21*a* is connected to the intake port 13. An electromagnetic type injector 18 for supplying high-pressure fuel from a fuel supply system is provided in the intake manifold 21*a*. The injector 18 is a port injection type fuel injector, which injects fuel toward the intake port 13 when a current is applied.

A surge tank 21*b* is provided farther upstream than the intake manifold 21*a*, with respect to the intake air flow direction. An exhaust pipe 22 is connected to the exhaust port 14.

An EGR (Exhaust Gas Recirculation) passage 23 is provided which connects the exhaust pipe 22 and the surge tank 21*b*, thereby enabling a part of exhaust gas that is discharged through the exhaust pipe 22 to be introduced into the intake air (hereinafter, the exhaust gas that is introduced is referred to as EGR gas). An EGR control valve 24 is interposed in the EGR passage 23. The EGR control valve 24 is provided for enabling an EGR ratio (a mixture ratio of EGR gas in the gas that is drawn into the combustion chamber 11*b* before combustion) to be controlled in accordance with the degree of opening of the EGR control valve 24.

A throttle valve 25 is interposed in an intake pipe 21 at a position that is farther upstream than the surge tank 21*b*, with respect to the intake air flow direction. The throttle valve 25 is controlled by operating a throttle actuator 26, which is a DC motor or the like. Furthermore, an air current control valve 27 is provided in the vicinity of the intake port 13, for producing swirl flow or tumble flow.

A catalyst 41, such as a 3-way catalyst, is provided in the exhaust pipe 22 for purifying CO, HC, NOx and the like in the exhaust gas. Furthermore, an air/fuel ratio sensor 40 (a linear A/F sensor or the like) for detecting an air/fuel ratio of the exhaust gas by detecting the exhaust gas is provided upstream from the catalyst 41.

The engine system 10 includes an ignition circuit unit 31 (corresponding to a drive circuit), an electronic control unit 32, and the like.

The ignition circuit unit 31 is configured such as to cause the spark plug 19 to generate a spark discharge for igniting the air-fuel mixture within the combustion chamber 11*b*. The electronic control unit 32 is a so-called engine ECU (where ECU is an abbreviation for Electronic Control Unit), which controls operations of units including the injector 18 and the ignition circuit unit 31 in accordance with the operating states (hereinafter, referred to as "engine parameters") of the engine 11, with the engine parameters being acquired based on outputs from various sensors including a crank angle sensor 33 and the like.

Regarding ignition control, the electronic control unit 32 operates such as to generate and output an ignition signal IGt and an energy input time period signal IGw based on the acquired engine parameters. The ignition signal IGt and the energy input time period signal IGw determine an optimum ignition timing and discharge current (ignition discharge current) in accordance with the condition of the gas in the combustion chamber 11*b* and the required output from the engine 11 (these vary in accordance with the engine parameters). Hence, the electronic control unit 32 corresponds to an ignition signal transmitting section, a weak discharge generating section, and a multiple discharge implementing section. Furthermore, the electronic control unit 32 corresponds to an in-cylinder pressure acquisition section, an air/fuel ratio determination section, a frequency signal transmitting section, and a smoldering state determination section.

The crank angle sensor 33 is a sensor that outputs a rectangular-wave crank angle signal each time the engine 11 attains a predetermined crank angle (for example, a period of 30° CA). The crank angle sensor 33 is installed in the engine block 11*a*. A coolant temperature sensor 34 is a sensor that is installed in the engine block 11*a* for detecting (acquiring) coolant temperature, which is a temperature of the coolant that flows in the water jacket 11*c*.

An air flow meter 35 is a sensor that detects (acquires) an intake air amount (the mass flow rate of the intake air that flows through the intake pipe 21 and is introduced into the interior of the combustion chamber 11*b*). The air flow meter 35 is installed upstream from the throttle valve 25, with respect to the intake air flow direction, and is mounted on the intake manifold 21. The intake pressure sensor 36 is a sensor that detects (acquires) intake air pressure, which is pressure within the intake manifold 21, and is mounted on the surge tank 21*b*.

The throttle opening degree sensor 37 is a sensor that generates an output in accordance with an opening degree (slot opening degree) of the throttle valve 25, and is built into the throttle actuator 26. The accelerator position sensor 38 is provided so as to produce an output in accordance with the amount of accelerator operation.

<Configuration Around the Ignition Circuit Unit>

Figure 2:
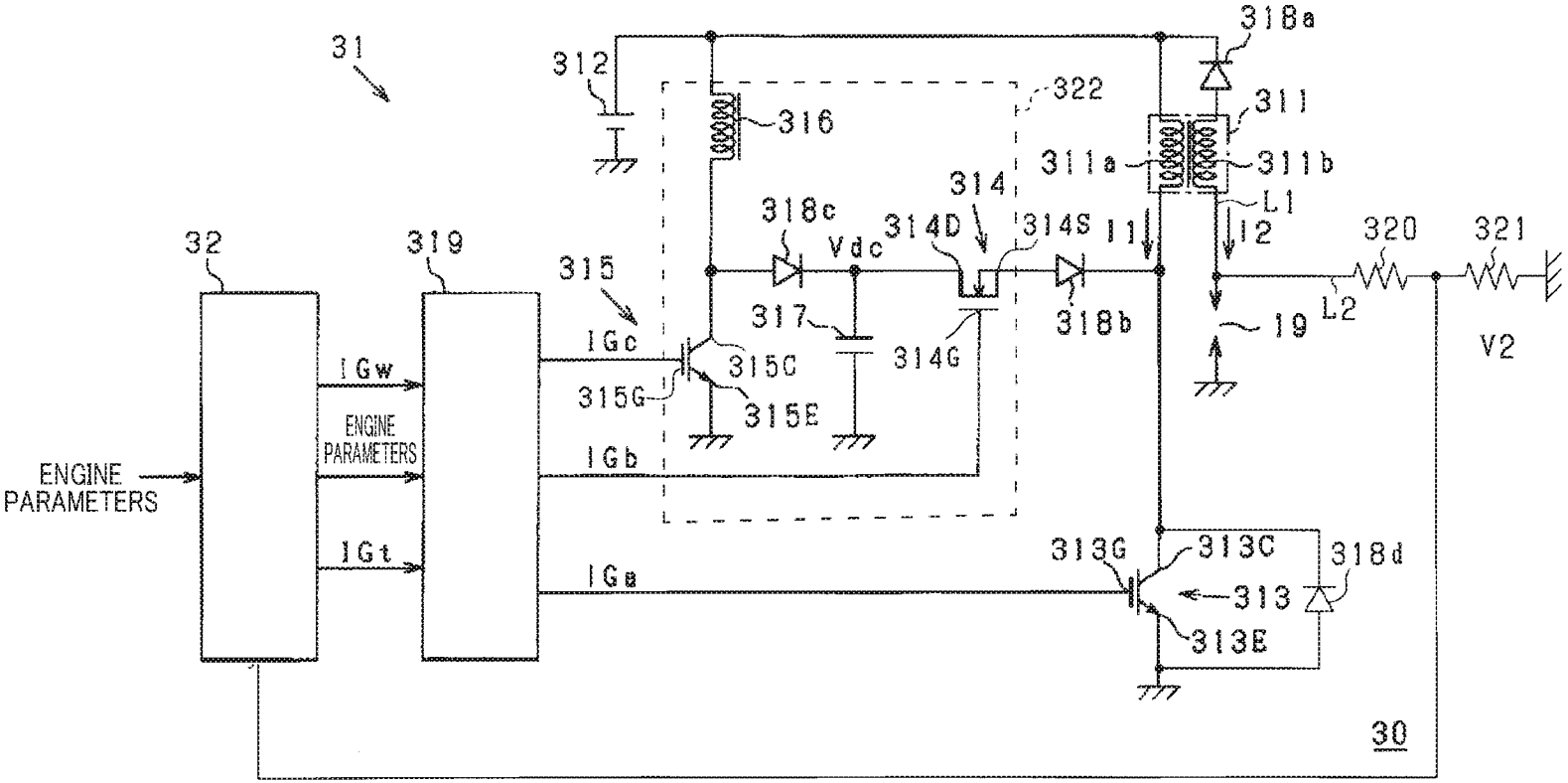
FIG. 2 is a schematic circuit diagram of the surroundings of an ignition circuit unit shown in FIG. 1.

Referring to FIG. 2, the ignition circuit unit 31 includes an ignition coil 311 (which includes a primary winding 311*a* and a secondary winding 311*b*), a DC power source 312, a first switching element 313, an additional energy inputting circuit 322, diodes 318*a*, 318*b* and 318*d*, and a driver circuit 319.

As described above, the ignition coil 311 has a primary winding (corresponding to a primary coil) 311*a* and a secondary winding (corresponding to a secondary coil) 311*b*. As is well known, the ignition coil 311 is configured such as to generate a secondary current in the secondary winding 311*b* by increasing or decreasing a primary current that flows in the primary winding 311*a*.

An ungrounded side output terminal (specifically, positive terminal) side of the DC power source 312 is connected to a high-voltage side terminal (also referred to as ungrounded side terminal) side that is one end of the primary winding 311*a*. On the other hand, a low-voltage side terminal (also referred to as ground side terminal) side, which is the other end of the primary winding 311*a*, is connected via the first switching element 313 to the grounded side. That is, the DC power source 312 is provided so as to pass a primary current from the high-voltage side terminal side toward the low-voltage side terminal side of the primary winding 311*a* when the first switching element 313 is turned on.

The high-voltage side terminal (also referred to as ungrounded side terminal) side of the secondary winding 311*b* is connected via the diode 318*a* to the high-voltage side terminal side of the primary winding 311*a*. The diode 318*a* blocks the current flow in the direction from the high-voltage side terminal side of the primary winding 311*a* toward the high-voltage side terminal side of the secondary winding 311*b*, while also having the anode of the diode connected to the high-voltage side terminal side of the secondary winding 311*b* such as to determine the direction of flow of the secondary current (discharge current) from the spark plug 19 as being toward the secondary winding 311*b* (that is, the current I2 in the drawing has a negative value).

On the other hand, the low-voltage side terminal (also referred to as ground side terminal) side of the secondary winding 311*b* is connected to the spark plug 19, and a voltage detection-use path (corresponding to a secondary voltage detection section) L2 is connected in the path L1 that connects the low-voltage side terminal and the spark plug 19. Resistors 320, 321 for voltage detection are provided in the voltage detection-use path L2. One terminal of the resistor 320 is connected to the path L1 while the other terminal is connected to the resistor 321. One terminal of the resistor 321 is connected to the resistor 320, while the other terminal is connected to ground. The node (whose reference number is not indicated in the drawing) between the resistors 320 and 321 is connected to the electronic control unit 32 described hereinafter. The secondary voltage V2 that is applied to the spark plug 19 is detected by means of the voltage detection-use path L2.

The first switching element 313 is an IGBT (Insulated Gate Bipolar Transistor) which is a MOS gate structure transistor, and has a first control terminal 313G, a first power supply side terminal 313C, and a first ground side terminal 313E. A diode 318*d* is connected in parallel between two terminals (the first power supply side terminal 313C and the first ground side terminal 313E) of the first switching element 313. The first switching element 313 is configured such that on/off control of the flow of current between the first power supply side terminal 313C and the first ground side terminal 313E is performed based on a first control signal that is inputted to the first control terminal 313G. In the present embodiment, the first power supply side terminal 313C is connected to the low-voltage side terminal side of the primary winding 311*a*. Furthermore, the first ground side terminal 313E is connected to the ground.

The additional energy inputting circuit 322 is configured by a second switching element 314, a third switching element 315, an energy storage coil 316, a capacitor 317 and a diode 318*c*.

The second switching element 314 is a MOSFET (Metal Oxide Semiconductor Field Effect Transistor) having a second control terminal 314G, a second power supply side terminal 314D, and a second ground side terminal 314S. The second switching element 314 is configured such that on/off control of the flow of current between the second power supply side terminal 314D and the second ground side terminal 314S is performed based on a second control signal that is inputted to the second control terminal 314G.

In the present embodiment, the second ground side terminal 314S is connected via the diode 318*b* to the low-voltage side terminal side of the primary winding 311*a*. The anode of the diode 318*b* is connected to the second ground side terminal 314S, such as to allow current to flow from the second ground side terminal 314S of the second switching element 314 to the low-voltage side terminal side of the primary winding 311*a*.

The third switching element 315 is an IGBT which is a MOS gate structure transistor, and has a third control terminal 315G, a third power supply side terminal 315C, and a third ground side terminal 315E. The third switching element 315 is configured such that on/off control of the flow of current between the third power supply side terminal 315C and the third ground side terminal 315E is performed based on a third control signal that is inputted to the third control terminal 315G.

In the present embodiment, the third power supply side terminal 315C is connected via the diode 318*c* to the second power supply side terminal 314D of the second switching element 314. The anode of the diode 318*c* is connected to the third power supply side terminal 315C such as to allow current flow from the third power supply side terminal 315C of the third switching element 315 to the second power supply side terminal 314D of the second switching element 314. Furthermore, the third ground side terminal 315E of the third switching element 315 is connected to the ground.

The energy storage coil 316 is an inductor that is provided for storing energy which results when the third switching element 315 is turned on. The energy storage coil 316 is interposed in a power source line that connects the above-described ungrounded side output terminal of the DC power source 312 and the third power supply side terminal 315C of the third switching element 315.

The capacitor 317 is connected in series with the energy storage coil 316, between the ground and the above-described ungrounded side output terminal of the DC power source 312. That is, relative to the energy storage coil 316, the capacitor 317 is connected in parallel with the third switching element 315. The capacitor 317 is provided for storing energy that results from the third switching element 315 being switched off.

The driver circuit 319 is connected to the electronic control unit 32 such as to receive engine parameters, the ignition signal IGt, and the energy input time period signal IGw that are outputted from the electronic control unit 32. Furthermore, the driver circuit 319 is connected to the first control terminal 313G, the second control terminal 314G and the third ground side terminal 315G such as to control the first switching element 313, the second switching element 314, and the third switching element 315. The driver circuit 319 is provided so as to output the first control signal, the second control signal and the third control signal to the first control terminal 313G, the second control terminal 314G and the third control terminal 315G, respectively, based on the received ignition signal IGt and energy input time period signal IGw.

Specifically, during discharge by the spark plug 19 (which is started when the first switching element 313 is turned off), the driver circuit 319 discharges stored energy from the capacitor 317 (this is performed by turning the third switching element 315 off and turning the second switching element 314 on). The discharged stored energy becomes input energy, which is supplied to the low-voltage side terminal side of the primary winding 311*a*. As a result, a primary current, which results from the input energy supplied during the discharge, flows through the primary winding 311*a*. Hence, an additional component, which accompanies the primary current flow, is superimposed on the secondary current produced by the secondary winding 311*b*. In this way, successive additions to the primary current are produced by the stored energy of the capacitor 317. Since successive additions to the secondary current correspondingly occur, the secondary current is suitably secured to an extent that enables a discharge to be continued, so that a continuous discharge can be effected.

On the other hand, the driver circuit 319 can cause the spark plug 19 to generate multiple discharges. Specifically, with the third switching element 315 being in an on state and the second switching element 314 being in an off state, alternating on/off operation of the first switching element 313 is performed by transmitting the ignition signal IGt to the first switching element 313 a plurality of times. As a result, spark discharges are generated a plurality of times between the discharge electrodes of the spark plug 19. It is noted that it is not essential for the third switching element 315 to be in an on state.

When the combustion of fuel is attempted by causing the spark plug 19 to generate a spark discharge, if the concentration of the air-fuel mixture that is drawn into the combustion chamber 11*b* is high, and the fuel and air are not sufficiently mixed, then incomplete combustion of the fuel will occur, causing carbon to be produced. If this carbon adheres to the outer circumference of the center electrode of the spark plug 19, a discharge (inner flying discharge) will occur between the metal attachment fittings of the spark plug 19 and the adhering carbon. If this spark discharge occurs, then since the time period of duration of the secondary current becomes short, satisfactory combustion of the air-fuel mixture cannot be achieved, and misfire occurs. That condition is referred to as smoldering.

Figure 3:
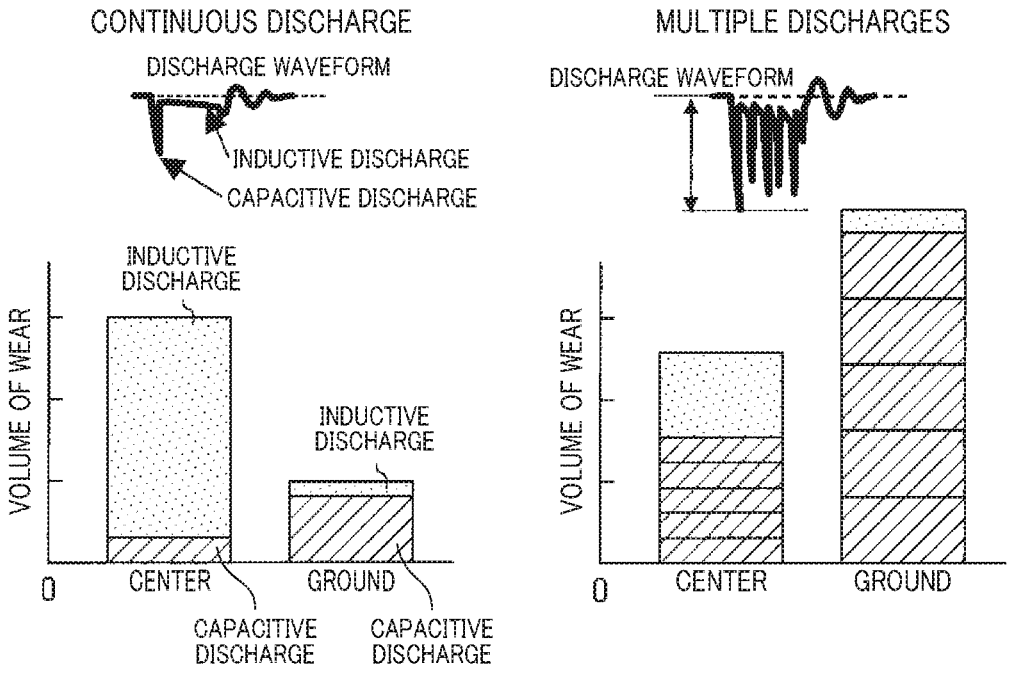
FIG. 3 is a diagram for use in comparing the degrees of wear of the discharge electrodes of a spark plug between a continuous discharge and multiple discharges.

In the conventional art, as a measure against this smoldering, multiple discharges have been generated at timings when the in-cylinder pressure becomes higher than the in-cylinder pressure at the ignition timings, for thereby burning off the carbon that adheres to the spark plug 19. However, since multiple discharges generate a plurality of spark discharges between the discharge electrodes of the spark plug 19, the wear of a ground electrode 193 described hereinafter is especially great (see FIG. 3) compared with a continuous discharge in which a single discharge is generated and is thereafter continued. Furthermore, since the multiple discharges are caused to be generated when the in-cylinder pressure is high, the energy during the discharge becomes high, which promotes wear of the discharge electrodes, causing shortening of the life of the electrodes.

Figure 4:
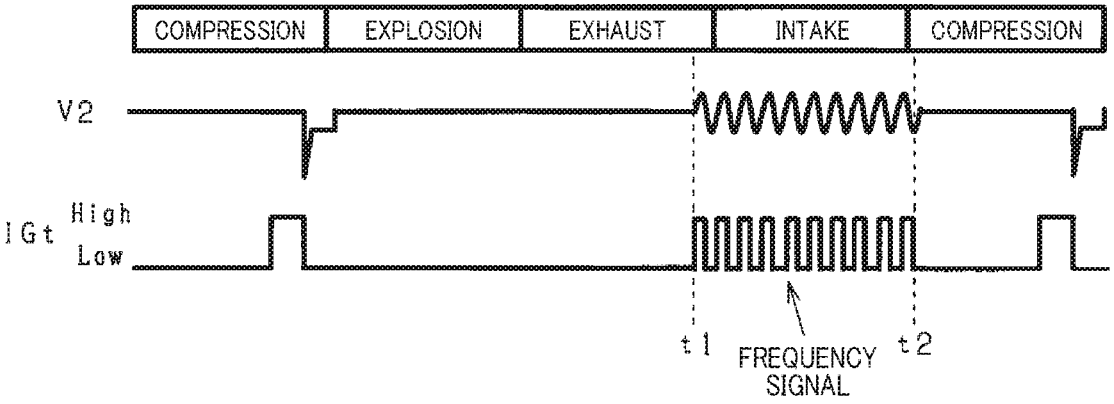
FIG. 4 is a timing diagram of a processing procedure for control of generating streamer discharges, according to the present embodiment.

Hence if it is determined that there is smoldering of the spark plug 19, then during the intake stroke, the electronic control unit 32 of the present embodiment transmits a frequency signal having a predetermined frequency to the first switching element 313 as shown in FIG. 4, as the ignition signal IGt (see interval t1-t2). At that time, a time period in which the ignition signal IGt transmitted during the intake stroke is high is an interval during which the first switching element 313 is in an on state (conduction is caused between the low-voltage side terminal of the primary winding 311*a* and the ground via the first switching element 313). On the other hand, a time period in which the ignition signal IGt is low is an interval during which the first switching element 313 is in an off state (the first switching element 313 electrically isolates the low-voltage side terminal of the primary winding 311*a* from the ground). It is noted that the third switching element 315 is in an on state and the second switching element 314 is in an off during the time period in which the frequency signal is transmitted to the first switching element 313 as the ignition signal IGt. The spark plug 19 is made to generate streamer discharges a plurality of times by repetitive execution of the above control based on the frequency signal. Here, the term "streamer discharge" in the present embodiment signifies a weak discharge that includes a corona discharge and has a small secondary current. It is noted that it is not essential for the third switching element 315 to be in an on state. Furthermore, the interval in which the frequency signal is transmitted as shown in FIG. 4 (the interval t1-t2) may include the whole time period of the intake stroke or may be set as part of the time period of the intake stroke.

Figure 5:
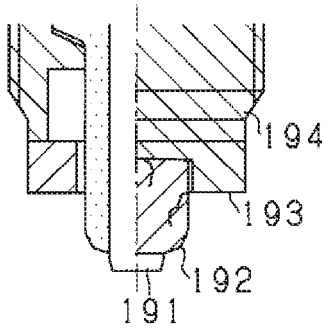
FIG. 5 is a schematic configuration diagram of a spark plug according to the present embodiment.

The schematic configuration of the spark plug 19 will be described with reference to FIG. 5. The spark plug 19 includes a center electrode 191, an insulator 192, a ground electrode 193 and a housing 194. The insulator 192 covers the outer circumference of the center electrode 191, while securing electrical insulation between the center electrode 191, and the housing 194 and ground electrode 193. The base end of the insulator 192 is fixed by the housing 194, with by caulking. A space (discharge space) is partitioned between the part of the insulator 192 that is exposed from the housing 194 and the ground electrode 193. A streamer discharge is generated such as to extend from the surface of the ground electrode 193 over the insulator 192 toward the center electrode 191.

This streamer discharge is non-equilibrium plasma. Hence, the temperature of electrons in the plasma is high, whereas the ion temperature of fuel gas contained in the plasma is low. For example, in the case of equilibrium plasma, such as an arc discharge, the ions of fuel gas contained in the plasma and the electrons that constitute the plasma are both at substantially the same high temperature, and there is a risk of wear of the discharge electrodes of the spark plug 19 being caused by the high temperatures. For that reason with this control, by causing the spark plug 19 to generate streamer discharges, the frequency of exposing the discharge electrodes of the spark plug 19 to high temperatures can be lowered, and wear of the discharge electrodes can be accordingly suppressed.

Figure 6:
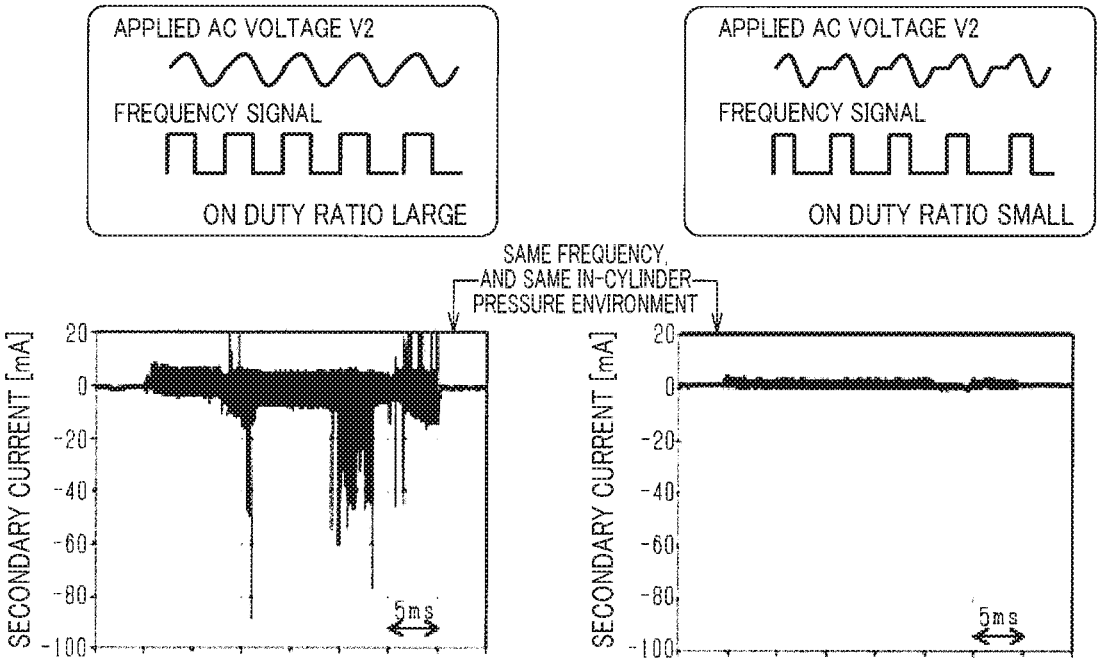
FIG. 6 is a diagram showing a dependency of occurrence frequency of streamer discharges upon the magnitude of an on duty ratio of a first switching element.

To increase the frequency of generating these streamer discharges, the frequency signal is controlled such as to change a duty ratio (hereinafter, referred to as on duty ratio) of a conduction time period of the first switching element 313 to the conduction time period and a blocking time period of the first switching element 313. Specifically, as shown in FIG. 6, if the on duty ratio of the first switching element 313 is small, a secondary current that flows to the spark plug 19 becomes small, and no streamer discharges are generated (see the right-side part of FIG. 6). On the other hand, in the same in-cylinder pressure environment, and the same frequency of the frequency signal, if the on duty ratio of the first switching element 313 is made large, then large negative peaks of the secondary current flowing to the spark plug 19 start to be generated (see the left-side part of FIG. 6). When these negative peaks are generated, many streamer discharges become generated by the spark plug 19. That is, if the pressure in the combustion chamber 11*b* (hereinafter, referred to as in-cylinder pressure) is constant, the frequency of producing the streamer discharges increases if the on duty ratio of the first switching element 313 is adjusted to be large.

Figure 7:
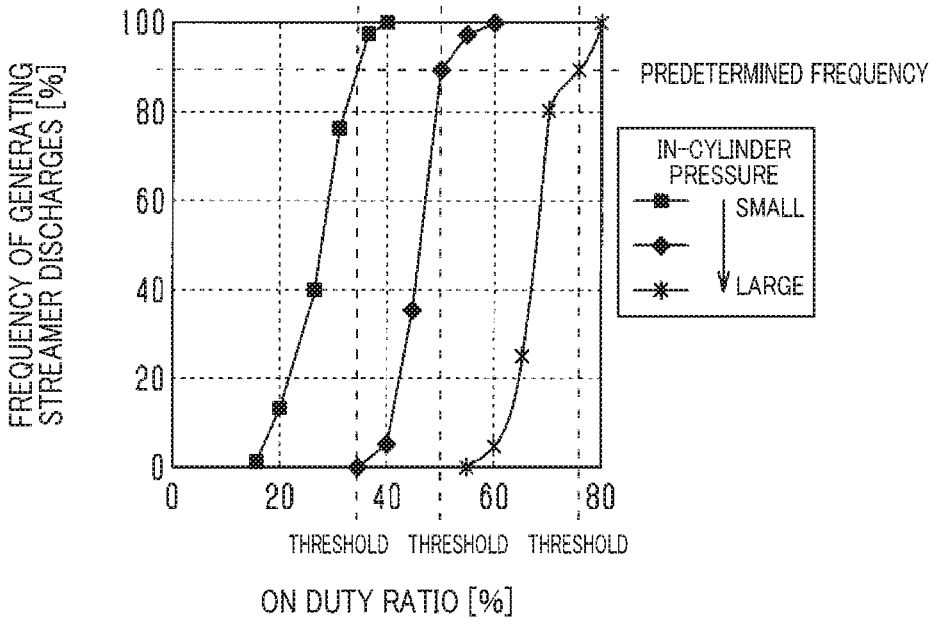
FIG. 7 is a diagram showing variation in occurrence frequency of streamer discharges that accompany variation in the ON duty ratio of the first switching element, for each of in-cylinder pressures.

Furthermore, as shown in FIG. 7, when the frequency of generating the streamer discharges is kept constant, as the in-cylinder pressure is higher, the on duty ratio of the first switching element 313 is required to be set greater. The reason for this is that, the higher the in-cylinder pressure, the greater is the energy required to generate a spark discharge by the spark plug 19. The generation frequency is a value obtained by dividing the number of occurrences of the streamer discharges by the spark plug 19 by the number of times that the first switching element 313 is switched off, during the time period in which the frequency signal is being transmitted.

Based on the above, in the present embodiment, threshold values of the on duty ratio of the first switching element 313, by which the frequency of generating the streamer discharges will be more than a predetermined frequency, are set for each of respective in-cylinder pressures, and the on duty ratio of the first switching element 313 is controlled so as to be the smallest value in a range of values that are greater than the set threshold value.

Figure 8:
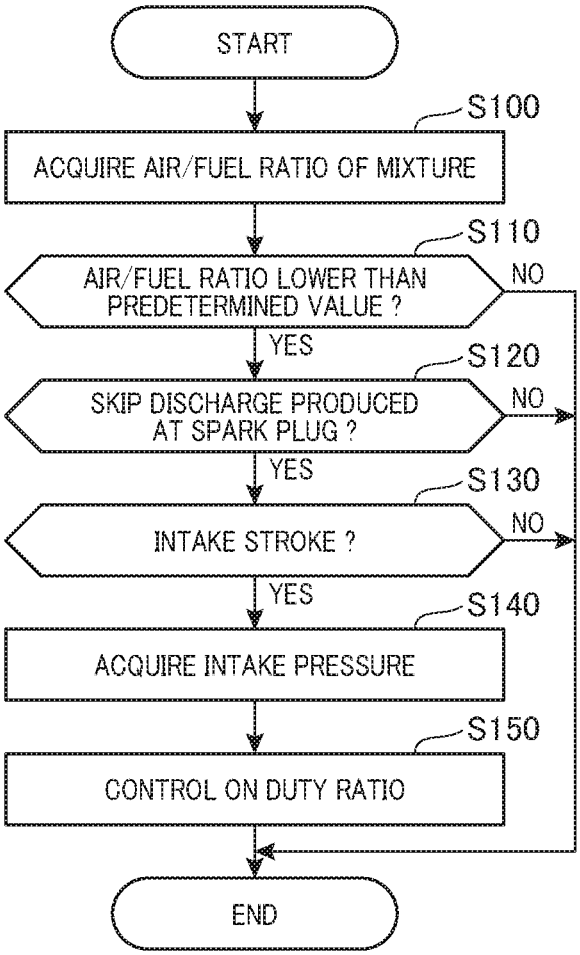
FIG. 8 is a flow diagram of control that is executed by an electronic control unit of the present embodiment.

In the present embodiment, the electronic control unit 32 performs the streamer discharge generation control shown in FIG. 8 and described later. The streamer discharge generation control shown in FIG. 8 is repetitively performed at predetermined intervals by the electronic control unit 32 while the power source of the electronic control unit 32 is in an on state.

Firstly, in step S100, an air/fuel ratio of the exhaust gas that is currently being discharged is obtained by the air/fuel ratio sensor 40. Next, in step S110, a determination is made as to whether or not the obtained air/fuel ratio of the exhaust gas is less than a predetermined value. The predetermined value is set as a threshold value for determining whether or not the air/fuel ratio is rich (is higher than the logical air/fuel ratio). Hence, if a YES determination is made in the processing of step S110, it can be understood that, at least up to now, the engine 11 has been running in an operation region in which the air/fuel ratio of the air-fuel mixture in the combustion chamber 11*b* is rich. If it is determined that the obtained air/fuel ratio of the exhaust gas is higher than the predetermined value (S110: NO), the present control is ended. If it is determined that the obtained air/fuel ratio of the exhaust gas is lower than the predetermined value (S110: YES) then process advances to step S120.

Figure 9:
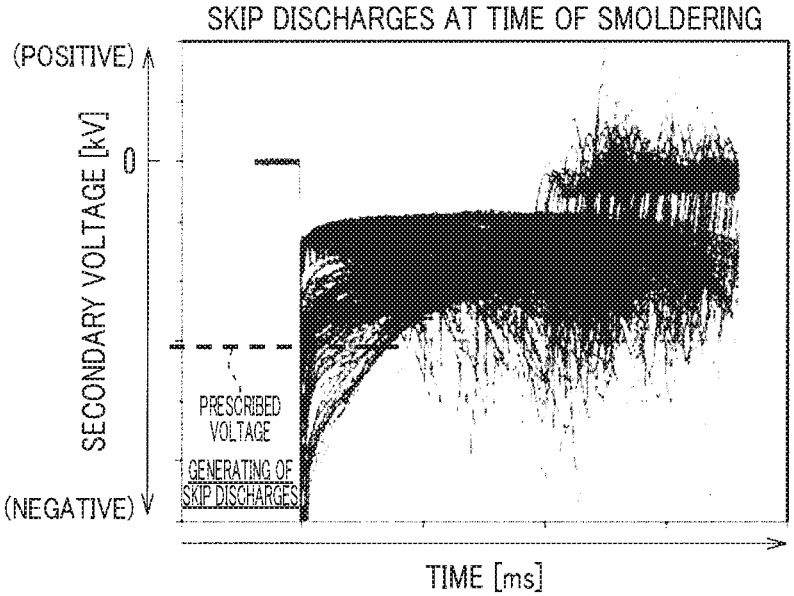
FIG. 9 is a diagram showing variation of a secondary voltage in a case where an inner flying discharge is generated by the spark plug.

If the engine 11 has been running, up to the present time, in an operation region in which the air/fuel ratio of the air-fuel mixture in the combustion chamber 11*b* is rich, it is assumed that there has been an environment in which carbon can readily adhere to the spark plug 19. In view of this, a decision is made, in step S120, as to whether or not an inner flying discharge was generated in the spark plug 19 by the secondary voltage that was applied to the spark plug 19 in the preceding combustion cycle. Specifically, a decision is made as to whether or not the first one of the peaks of the secondary voltage detected by means of the voltage detection-use path L2, when the spark discharge was generated based on the ignition signal IGt, was lower than a prescribed voltage (see FIG. 9). If it is determined that the first one of the peaks of the secondary voltage applied to the spark plug 19 was lower than the prescribed voltage, and an inner flying discharge was not generated by the spark plug 19 (S120: NO), then this control is ended. If it is determined that the first peak of the secondary voltage applied to the spark plug 19 was higher than the prescribed voltage, and an inner flying discharge was generated by the spark plug 19 (S120: YES) then the processing advances to step S130.

In step S130 a determination is made as to whether or not the current combustion cycle of the engine 11 is an intake stroke. If it is determined that the current combustion cycle of the engine 11 is not an intake stroke (S130: NO), the present control is ended. If it is determined that the current combustion cycle of the engine 11 is an intake stroke (S130: YES), the process advances to step S140.

In step S140 the intake pressure detected by the intake pressure sensor 36 is obtained. Next in step S150, current in-cylinder pressure is estimated from the obtained intake pressure, and a threshold value is set based on the estimated in-cylinder pressure. The on duty ratio of the first switching element 313 is then controlled so as to be the smallest value within a range of values that are greater than the set threshold value. As a result, the frequency of the streamer discharges during the intake stroke is made higher than the predetermined frequency. The present control is then ended.

Due to the above configuration, the present embodiment provides the following effects.

Figure 10:
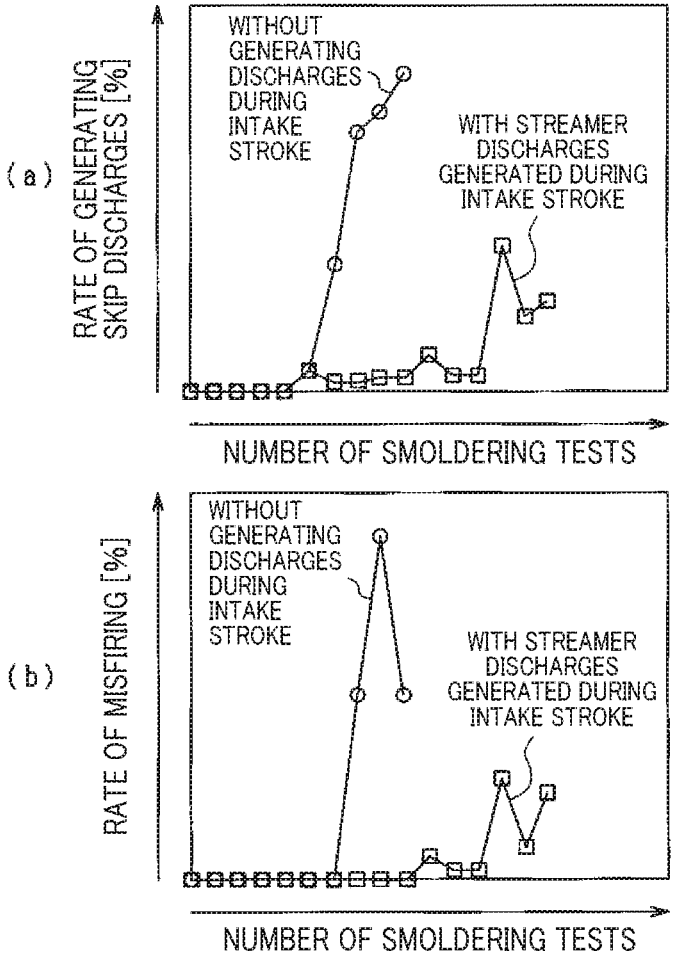
FIG. 10 is a diagram showing effects of the performed control according to the present embodiment.

By generating streamer discharges when the spark plug 19 is smoldering, the carbon that is adhering to the discharge electrodes of the spark plug 19 can be burned off, so that misfires caused by smoldering of the spark plug 19 can be suppressed. FIG. 10 shows comparison test results of improvement of the smoldering condition that were actually obtained by generating streamer discharges at the spark plug 19. The smoldering tests indicated along the horizontal axes in the respective graphs of FIG. 10 are combustion tests performed in a condition in which smoldering can readily occur, and the degree of smoldering of the spark plug 19 increases as the number of smoldering tests increases. In FIG. 10, FIG. 10(*a*) shows the change in the rate of generation of inner flying discharges and FIG. 10(*b*) shows the change in the rate of occurrence of misfires, for each of the numbers of the smoldering tests. If no streamer discharges are generated in the intake stroke, the rate of generation of inner flying discharges increases as the number of smoldering tests increases (FIG. 10(*a*)) and the increase of the rate of generation of inner flying discharges is accompanied by an increase in the rate of misfires (FIG. 10(*b*)). On the other hand, in the case where streamer discharges are generated in the intake stroke, although the rate of generation of inner flying discharges increases to some extent as the number of smoldering tests becomes large, it is apparent that the rate of generation of inner flying discharges is held lower than for the case where no streamer discharges are generated in the intake stroke (FIG. 10(*a*)). Furthermore, considering also the rate of misfires of the engine 11, it can be confirmed that the misfire rate is suppressed in comparison with the case where no streamer discharges are generated in the intake stroke (FIG. 10(*b*)). Hence, carbon that has been adhered to the spark plug 19 can be burned off by control of generation of streamer discharges in the intake stroke, and accordingly, the self-cleaning action of the spark plug 19 can be enhanced.

Figure 11:
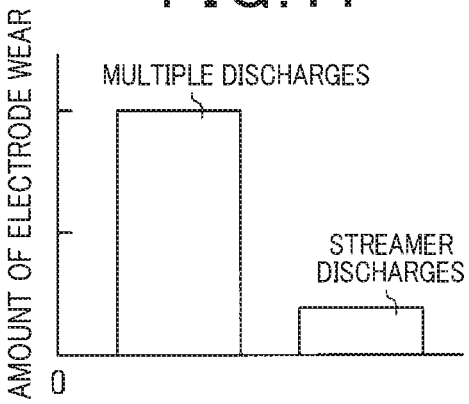
FIG. 11 is a diagram showing effects of the performed control according to the present embodiment.

Furthermore, the frequency signal is controlled to change the on duty ratio of the first switching element 313 in accordance with the in-cylinder pressure, such that the frequency of generation of streamer discharges at the spark plug 19, during the time period in which the frequency signal is transmitted, becomes higher than the predetermined frequency. Hence, even when the in-cylinder pressure changes, the on duty ratio of the first switching element 313 is changed each time, and hence the frequency of generation of the streamer discharges at the spark plug 19 can be controlled more reliably so as to be higher than the predetermined frequency. The control of streamer discharge generation is performed during the intake stroke. Hence, since generating the streamer discharges is performed in a condition in which the in-cylinder pressure is relatively low, the secondary current that is required for generating the streamer discharges can be kept at a low value. Furthermore, since the secondary current of the streamer discharges that flows to the spark plug 19 is less than the secondary current when a spark discharge is generated for igniting the air-fuel mixture, the secondary current that flows to the spark plug 19 can be substantially decreased, in comparison with the multiple discharges that are implemented in the conventional art. Accordingly, wear and shortening of the life of the electrodes of the spark plug 19 can be suppressed. FIG. 11 shows respective amounts of electrode wear of the spark plug 19 in the case of continuously implementing streamer discharges or multiple discharges for 100 hours under the same conditions of in-cylinder pressure and of gas environment within the cylinder. As shown by the graph, the amount of electrode wear of the spark plug 19 is greatly decreased when the streamer discharges are implemented compared with the case of implementing multiple discharges.

A threshold value of an on duty ratio of the first switching element 313 is predetermined for each of respective in-cylinder pressures, so as to make the frequency of generation of streamer discharges higher than the predetermined frequency, and the on duty ratio of the first switching element 313 is controlled so as to be the smallest value within a range of values that are greater than the set threshold value that. As a result, since the on duty ratio of the first switching element 313 becomes the minimum in a condition in which the frequency of generation of the streamer discharges is higher than the predetermined frequency, the secondary voltage that is applied to the spark plug 19 can be restricted to the lowest necessary value. Due to this, wear of the electrodes of the spark plug 19 can be more effectively suppressed.

The frequency signal is controlled such that, the greater the in-cylinder pressure, the greater is made the on duty ratio of the first switching element 313. As a result, since the secondary current that flows to the spark plug 19 is low, the frequency of generation of the streamer discharges can be prevented from falling below the predetermined frequency.

The streamer discharges are generated at the spark plug 19 on condition that it is determined that inner flying discharges at the spark plug 19 have been generated. As a result, since the generation of streamer discharges is limited to the case where the amount of carbon adhering to the discharge electrodes of the spark plug 19 is so large that inner flying discharges are generated, the frequency of performing the present control can be made small.

The secondary voltage that is detected by means of the voltage detection-use path L2 when inner flying discharges are generated tends to be higher than at the time when spark discharges are generated between the discharge electrodes. Hence, it can be determined that the spark plug 19 is in a smoldering condition from the fact that the first peak of the secondary voltage applied to the spark plug 19, during a time period in which the frequency signal is transmitted, is lower than a predetermined voltage.

The following modifications may be made to the above embodiment.

According to the above embodiment, the current value of in-cylinder pressure is estimated from the air intake pressure that is detected by the intake pressure sensor 36. However, it would be equally possible to estimate the current value of in-cylinder pressure from the degree of throttle opening that is detected by the throttle opening degree sensor 37, or to attach a cylinder pressure sensor to the combustion chamber 11*b* to directly detect the in-cylinder pressure.

Figure 12:
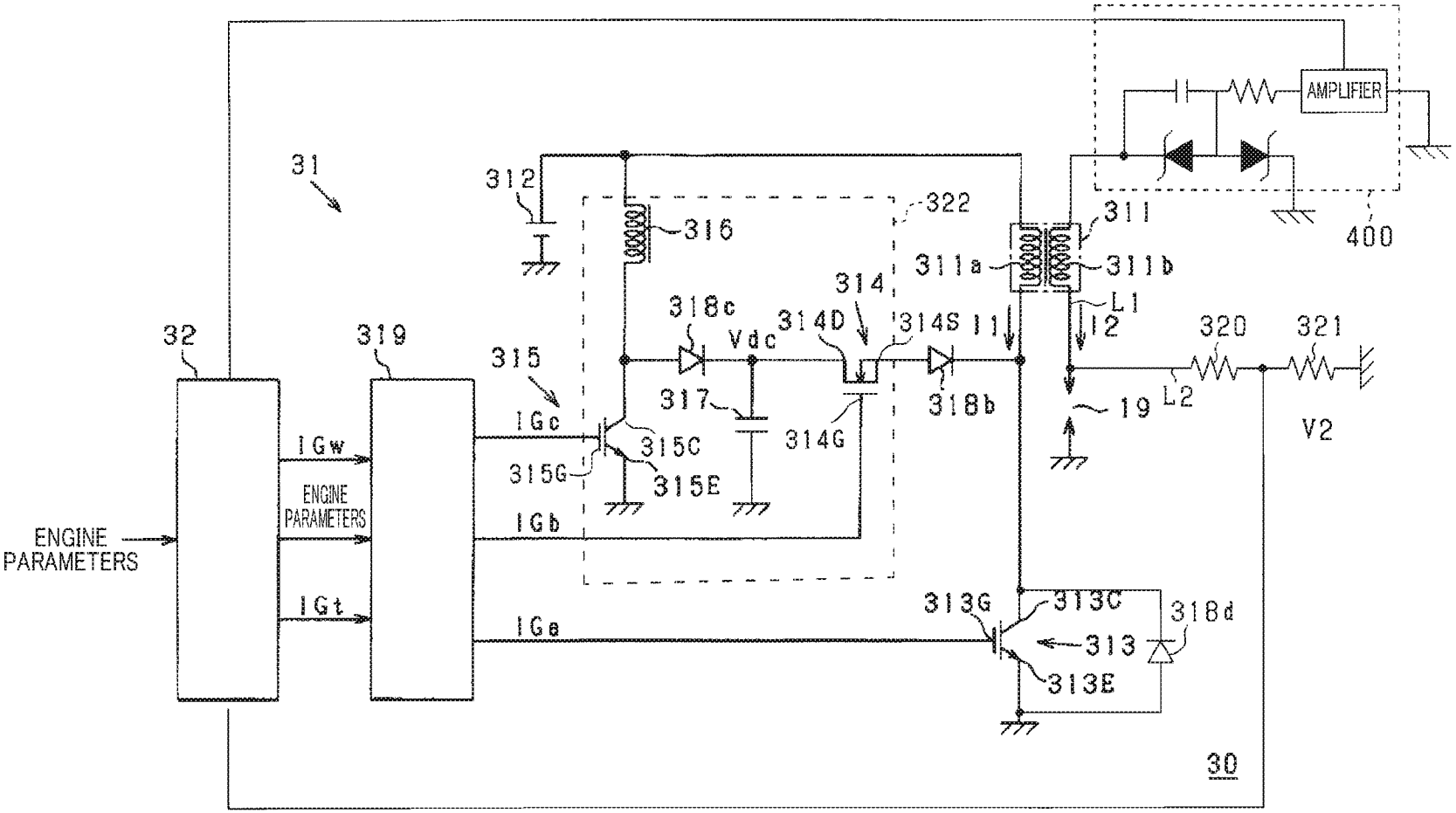
FIG. 12 is a schematic circuit diagram of the surroundings of an ignition circuit unit according to an other example.

In the above embodiment, the smoldering condition of the spark plug 19 is determined based on the secondary voltage that was applied to the spark plug 19 in the preceding combustion cycle. However, it is not essential for the determination of the smoldering condition of the spark plug 19 to be made based on the secondary voltage applied to the spark plug 19 in the preceding combustion cycle. For example, a leakage current detection section 400 (see FIG. 12) may be provided in the ignition circuit unit 31 for detecting a current (hereinafter, referred to as leakage current) that has leaked from the secondary winding 311*b*. If the spark plug 19 is in a smoldering condition, the leakage current that is detected by the leakage current detection section 400 will be large. It would be equally possible to determine that the spark plug 19 is in a smoldering condition if the leakage current has continued to flow at a value higher than a predetermined current value for a time period longer than a predetermined time period.

Alternatively, it would be equally possible to determine the smoldering condition of the spark plug 19 based on the insulation resistance value between the discharge electrodes of the spark plug 19. If there is a large amount of carbon adhering to the surfaces of the discharge electrodes and insulator of the spark plug 19, the insulation resistance value between the discharge electrodes becomes lower. If the insulation resistance value becomes lower, the secondary current that flows to the spark plug 19 will flow to the carbon adhering to the surfaces of the discharge electrodes and insulator, and discharges will be generated between the metal fittings of the spark plug 19 and the adhering carbon, so that the desired discharge for effecting ignition will not be achieved, and misfire will occur (the smoldering condition). That is, the degree of smoldering of the spark plug 19 can be estimated from the change in the insulation resistance value between the discharge electrodes. Hence, an insulation resistance value at which the spark plug 19 becomes in the smoldering condition can be set as a determination threshold value, and if the insulation resistance value has become less than the determination threshold value, it can be determined that the spark plug 19 is in the smoldering condition. Since the method of calculating the insulation resistance value between the discharge electrodes is based on a conventional method of calculation, the description of this is omitted herein.

Alternatively, it would be equally possible to determine that the spark plug 19 is in the smoldering condition if the spark plug 19 is in a state where carbon can readily adhere to the surfaces of the discharge electrodes and the insulator of the spark plug 19. An example of a state where carbon can readily adhere to the surfaces of the discharge electrodes and the insulator of the spark plug 19 is, for example, a case where the temperature of a wall surface of the combustion chamber 11*b* is low, or the temperature of intake air is low. In such a case, it is difficult for the fuel contained in the air-fuel mixture within the combustion chamber 11*b* to become vaporized. If combustion of the fuel occurs when the fuel is in a liquid state without being vaporized, it is difficult for complete combustion of the fuel to be achieved, so that carbon can readily be produced. In the present other example, if at least one of the following conditions (1) to (3) is satisfied, then it is determined that the fuel contained in the air-fuel mixture within the combustion chamber 11*b* is in a state where it is difficult for the fuel to be vaporized:

(1) The temperature of the coolant that is circulating in the water jacket 11*c* is lower than a predetermined coolant temperature.
(2) The temperature of an engine oil that circulates in the engine 11 is lower than a predetermined oil temperature.
(3) The temperature of intake air flowing into the intake tube 21 is lower than a predetermined temperature.

In the above embodiment, the on duty ratio of the first switching element 313 is controlled so as to be the minimum value within a range that is greater than the threshold value. However, it is not essential for the on duty ratio of the first switching element 313 to be the smallest value, and it may be greater than the threshold value.

In the above embodiment, if the first peak of the secondary voltage detected by means of the voltage detection-use path L2 is lower than a predetermined voltage when a spark discharge is generated based on the ignition signal IGt, it is determined that the spark plug 19 is smoldering. However, concerning this, it would be equally possible to calculate the absolute value of the first peak of the detected secondary voltage, and to determine that the spark plug 19 is smoldering if the calculated absolute value of the first peak is greater than the absolute value of a predetermined voltage (that is, a positive voltage).

First Other Example

Figure 13:
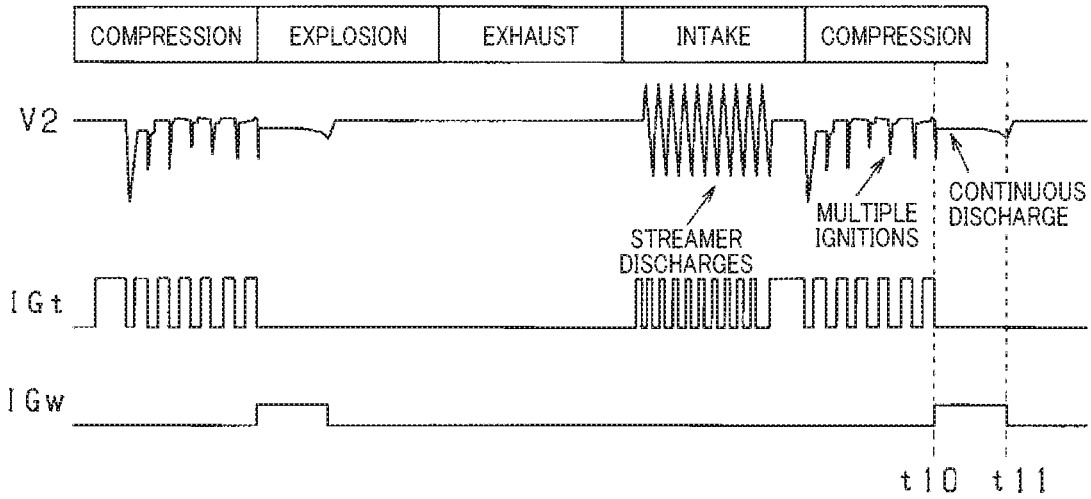
FIG. 13 is a timing diagram of a processing procedure for multiple discharge control according to the other example.

In the above embodiment, the generation of streamer discharges by the spark plug 19 is limited to the case in which the spark plug 19 is in a smoldering condition. However, it is not essential for the generation of streamer discharges to be limited to the case where the spark plug 19 is in a smoldering condition. For example, it would be equally possible to cause streamer discharges to be generated by the spark plug 19 in each intake stroke, regardless of the degree of advancement of the smoldering condition of the spark plug 19, if the air/fuel ratio of the exhaust gas obtained by the air/fuel ratio sensor 40 is in a state of being lower than a predetermined value. Furthermore, as shown in FIG. 13, in addition to causing streamer discharges to be generated during the intake stroke, multiple discharges are caused to be generated by the spark plug 19 before combustion of the fuel occurs during the compression stroke, if it is determined that an inner flying discharge was generated at the spark plug 19 in the preceding combustion cycle. However, the multiple discharges are generated in an environment in which the EGR ratio is greater than a predetermined ratio, with combustion of the fuel being difficult, so that combustion of the fuel will not occur by contact between the fuel spray and spark discharges that result from the multiple discharges. When combustion of the fuel occurs, the energy input time period signal IGw is transmitted such that the final spark discharge generated by executing the multiple discharges is continued, thereby causing the spark plug 19 to generate a continuous discharge (see interval t10-t11). As a result, even if the EGR ratio is made higher than the predetermined ratio, so that there is an environment in which combustion of the fuel is difficult, stable combustion of the fuel is enabled due to increased opportunities for contact between the fuel spray and the discharge.

Figure 14:
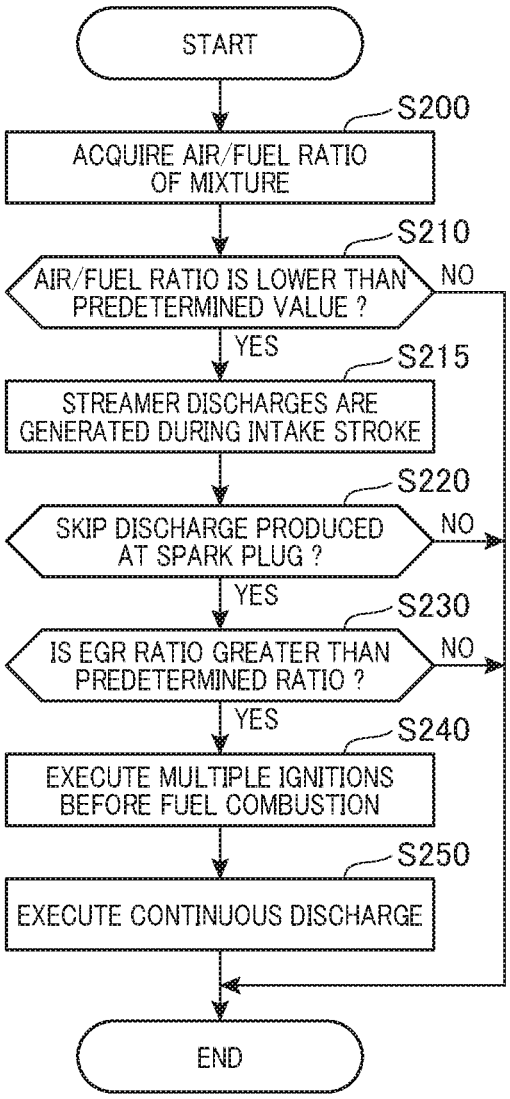
FIG. 14 is a flow diagram of control executed by an electronic control unit according to the other example.

An example of discharge control according to the present other example will be described. FIG. 14 is a partial modification of the flow diagram of FIG. 8. Specifically, step S215 is added, between step S210 which is the same processing as that of step S110 in FIG. 8 and step S220 which is the same processing as that of step S120 in FIG. 8. Step S215 corresponds to the control of the series of steps S130 to S150 in FIG. 8.

If there is a YES determination in the processing of step S220, the process advances to step S230, which is a new step. In step S230, a determination is made based on the degree of opening of the EGR control valve 24 as to whether or not the EGR ratio exceeds a predetermined ratio. If it is then determined that the EGR ratio is smaller than the predetermined ratio (S230: NO), the present control is ended. If it is determined that the EGR ratio is greater than the predetermined ratio (S230: YES), the process advances to step S240, which is a new step. In step S240, multiple discharges are generated before combustion of the fuel during a compression stroke. The process then advances to step S250, which is a new step, in which a continuous discharge is generated such as to continue a final spark discharge caused by the multiple discharges, thereby effecting combustion of the fuel. The present control is then ended.

Regarding to the other steps, the processing of step S200 in FIG. 14 is the same as that of step S100 of FIG. 8.

Even if the amount of carbon currently adhering to the spark plug 19 is not so large as to cause inner flying discharges to be generated, there is a risk that there will be some degree of adherence of carbon to the spark plug 19 if the running condition of the engine 11 up to the present has been in an operation region in which the air/fuel ratio of the air-fuel mixture in the combustion chamber 11*b* is rich. Hence, carbon adhering to the discharge electrodes of the spark plug 19 is burned off and smoldering of the spark plug 19 is suppressed, by causing streamer discharges to be generated by the spark plug 19. Furthermore, if it is determined that an inner flying discharge was generated at the spark plug 19 in the preceding combustion cycle, then in addition to effecting streamer discharges during the intake stroke, multiple discharges are generated by the spark plug 19, before causing a spark discharge to be generated by the spark plug 19 for effecting combustion of the fuel. In that way, carbon that has adhered on the spark plug 19 can be more reliably burned off.

In the first other example, if it is determined that an inner flying discharge has been generated at the spark plug 19 in the preceding combustion cycle, then in addition to producing streamer discharges during the intake stroke, multiple discharges are generated by the spark plug 19 during the compression stroke, before combustion of the fuel is effected. Regarding this, it is not essential for the streamer discharges to be generated during the intake stroke, before producing the multiple discharges by the spark plug 19 during the compression stroke, and either one of the streamer discharge control and the multiple discharge control may be performed.

Figure 15:
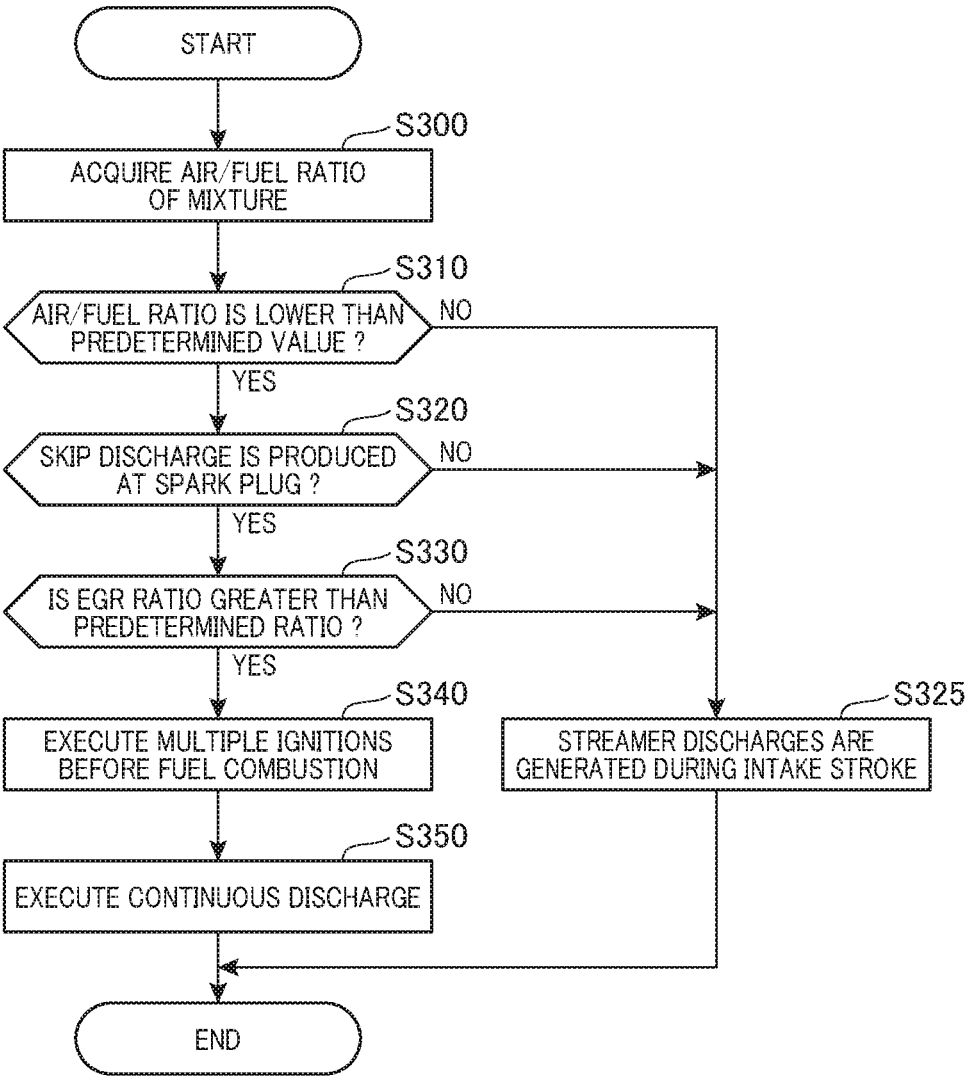
FIG. 15 is a flow diagram of control executed by an electronic control unit according to another example.

FIG. 15 is a partial modification of the flow diagram of FIG. 14. Specifically, step S215 of FIG. 14 is deleted. Furthermore, if NO determinations are made both in the determination processing of step S320, which is the same processing as that of step S220 in FIG. 14, and in the determination processing of step S330, which is the same processing as that of step S230 in FIG. 14, then the process advances to step S325, which is a new step whose processing is in accordance with step S215 of FIG. 13. When the processing of step S325 is completed, the present control is ended.

Regarding the other steps, steps S300, 310, 340 and 350 in FIG. 15 are respectively identical to steps S200, 210, 240 and 250 in FIG. 14.

It is possible for the equilibrium plasma produced by the spark plug 19 at the time of multiple discharges to have greater energy than the streamer discharges, and for carbon adhering to the spark plug 19 to be burned off by the equilibrium plasma over a wider range than by the streamer discharges. Hence, multiple discharges are generated on condition that it is determined that the degree of smoldering of the spark plug 19 is so great as to cause inner flying discharges to occur. These multiple discharges are generated in an environment in which the EGR ratio exceeds a predetermined ratio and in which combustion of the fuel is difficult to achieve even if the equilibrium plasma is produced during a short time period. In that way, the combustion of fuel within the combustion chamber 11*b* can be suppressed while also effectively burned off the carbon adhering to the spark plug 19, so that combustion misfire of the fuel can be prevented beforehand. Furthermore, the multiple discharges are generated before combustion of the fuel takes place when the in-cylinder pressure is comparatively low, and as a result, the energy required for these discharges can be made small, and wear of the discharge electrodes can be suppressed.

In another example 1 and another example that is applied to the example 1, the determination as to whether or not the environment is one in which combustion of the fuel is difficult is made based on a determination as to whether or not the EGR ratio is greater than a predetermined ratio. However, it would be equally possible, for example, to determine whether or not the air/fuel ratio of the exhaust gas that is currently being discharged is lean. Specifically, in step S210 of FIG. 14, if it is determined that the air/fuel ratio of the exhaust gas that is currently being discharged is lean to such an extent that the ratio is higher than a predetermined value (S210: NO), then the process may advance to step S260. The same modification can be applied to step S310 of FIG. 15. Also according to such configurations, the effects of the other examples in which the controls shown in FIGS. 14 and 15 are performed are provided.

Other Example 2

In the above embodiment, the control of generating the streamer discharges is performed by using electrical power supplied from the DC power source 312. However, it would be equally possible for the control of generating the streamer discharges to be performed by a configuration provided with a plurality of power sources, which apply respectively different voltages to the ignition coil 311.

Figure 16:
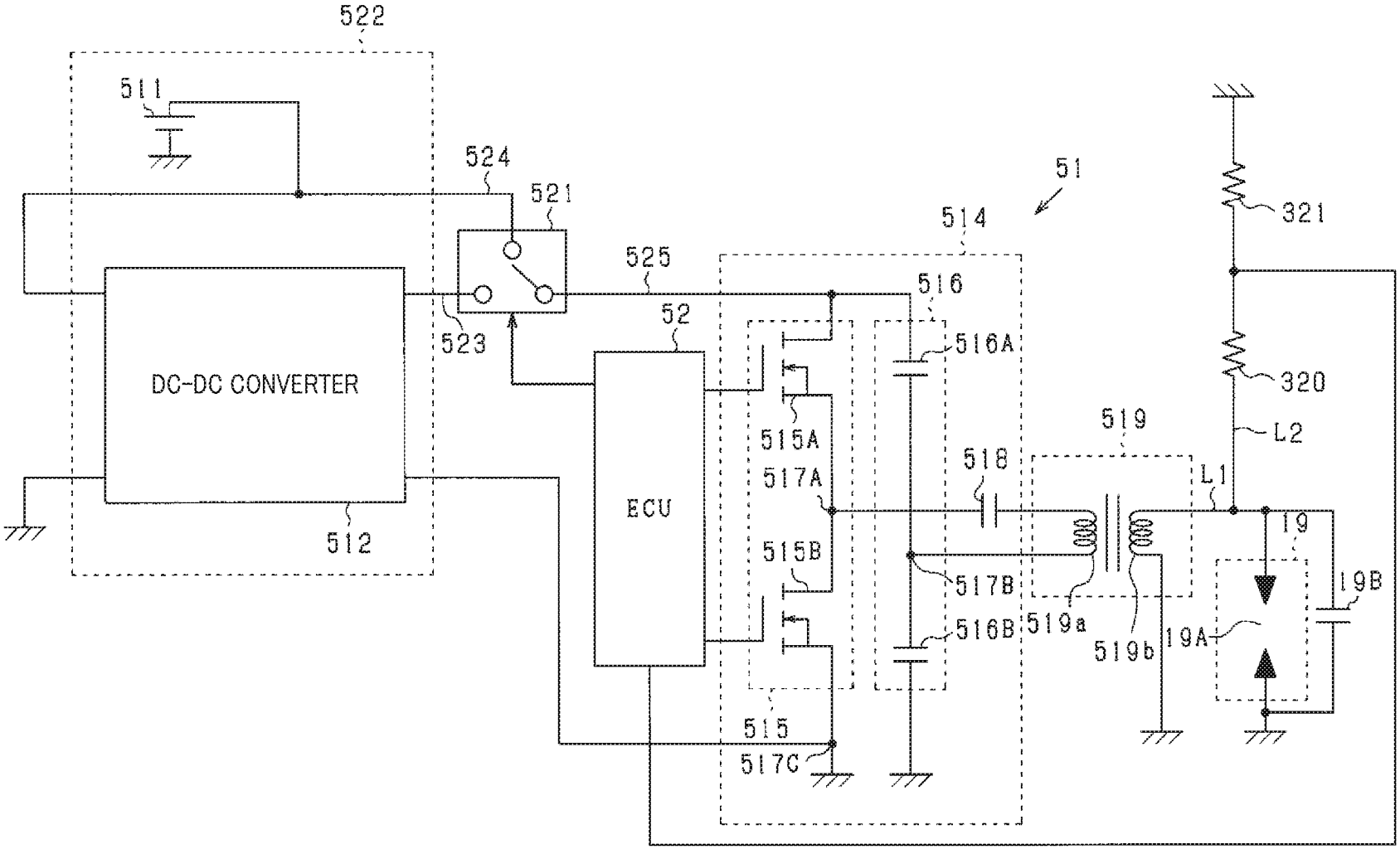
FIG. 16 is schematic circuit diagram of the surroundings of an ignition circuit unit according to another example.

The configuration of the present other example is shown in FIG. 16. The ignition circuit unit 51 shown in FIG. 16 is provided with an ignition coil 519 (which includes a primary winding 519*a* and a secondary winding 519*b*), a power supply section 522, a switching section 514 and a relay 521.

The power supply section 522 includes a battery 511 and a DC-DC converter 512. The battery 511 and the DC-DC converter 512 are connected in series. A current path 524 (corresponding to a first current path) branches off from a current path that connects the battery 511 and the input side of the DC-DC converter 512 and does not pass through the DC-DC converter 512. The voltage supplied from the battery 511 is about 12 (V) to 24 (V), and based on that, the DC-DC converter 512 increases the voltage to about 40 (V) to 90 (V).

Both the current path 524 that does not pass through the DC-DC converter 512 and a current path 523 (corresponding to a second current path) that is connected to the output side of the DC-DC converter 512 are interrupted. A relay 521 (corresponding to a path changing means) is provided so as to compensate for the interrupted paths. A current path 525, which is connected to the relay 521, is connected to the switching section 514.

The switching section 514 includes a series-connected body 515 of switching elements, a series-connected body 516 of capacitors, and a capacitor 518.

In the series-connected body 516 of capacitors, a first terminal of the capacitor 516A present at the high side is connected via the current path 525 to the relay 521 and a second terminal of the capacitor 516A is connected to a first terminal of the capacitor 516B. The second terminal of the capacitor 516B is connected to the ground. A current path connected with the low-voltage side terminal of the primary winding 519*a* of an ignition coil 519, described later, branches from the connection point 517B between the capacitor 516A and the capacitor 516B.

The series-connected body 515 of switching elements is connected in parallel with the series-connected body 516 of capacitors. In the series-connected body 515 of switching elements, the drain terminal of the switching element 515A at the high side is connected via the current path 525 to the relay 521, while the source terminal of the switching element 515A is connected to the drain terminal of the switching element 515B. The source terminal of the switching element 515B is connected to the ground. A current path branches from the connection point 517A between the switching element 515A and the switching element 515B via the capacitor 518 and is connected with a high-voltage side terminal of the primary winding 519*a* of the ignition coil 519 described later. Furthermore, a current path that branches from the connection point 517C between the source terminal of the switching element 515B and the ground is connected to the ground via the DC-DC converter 512.

The ignition coil 519 includes a primary winding 519*a* and a secondary winding 519*b*.

The connection point 517A between the switching element 515A and the switching element 515B is connected via the capacitor 518 to a high-voltage side terminal side that is one end of the primary winding 519*a*. On the other hand, the connection point 517B between the capacitor 516A and the capacitor 516B is connected to a low-voltage side terminal side that is the other end of the primary winding 519*a*.

The high-voltage side terminal side of the secondary winding 519*b* is connected to the spark plug 19, and the voltage detection-use path L2 is connected to the current path L1, which is connected to the spark plug 19 and which connects the high-voltage side terminal and the spark plug 19. Since the configuration of the voltage detection-use path L2 is the same as that in the above embodiment, the description thereof is omitted. The low-voltage side terminal side of the secondary winding 519*b* is connected to the ground.

Although the spark plug 19 has the same configuration as that in the above embodiment, the configuration is shown more specifically in the drawing. The spark plug 19 has counter electrodes 19A, and a stray capacitance 19B is shown in the drawing. The stray capacitance 19B is a capacitance component that is formed of the counter electrodes 19A, an insulator that surrounds the outer circumference of the counter electrodes 19A, and the ground. There is a parallel connection relationship between the counter electrodes 19A and the stray capacitance 19B.

In addition to acquiring the secondary voltage V2 that is detected by means of the voltage detection-use path L2 and is applied to the spark plug 19, the ECU 52 according to the present other embodiment controls opening and closing operations of the switching element 515A and the switching element 515B, and controls path changing by the relay 521.

The ECU 52 transmits opening and closing signals to the switching element 515A and the switching element 515B such that the switching element 515A and the switching element 515B perform complementary opening and closing operations. At that time, the frequency of the opening and closing signals transmitted to the switching element 515A and the switching element 515B is adjusted to be the frequency (resonance frequency) by which a voltage resonance is produced by the stray capacitance 19B of the spark plug 19 and the secondary winding 519*b*. As a result of the complementary opening and closing operations of the switching element 515A and the switching element 515B, a primary voltage is applied to the primary winding 519*a* alternately from the capacitors 516A and 516B. That is, an AC voltage is applied to the primary winding 519*a*. As a result, an induced voltage is produced in the secondary winding 519*b*, thereby causing a plasma discharge to be generated at the spark plug 19.

Furthermore, if it is determined that the spark plug 19 is in a smoldering condition based on the secondary voltage V2 detected by means of the voltage detection-use path L2, while also it is determined that the current combustion cycle of the engine 11 is an intake stroke, then the ECU 52 transmits a control signal to the relay 521. As a result, the current path 524 becomes connected to the current path 525 via the relay 521 (corresponding to a first condition). On the other hand, if it is determined that the spark plug 19 is not in a smoldering condition or it is determined that the current combustion cycle of the engine 11 is not an intake stroke, then a control signal is transmitted to the relay 521 such that the current path 523 becomes connected via the relay 521 to the current path 525 (corresponding to a second condition).

In a configuration such as that of the present other example, in which an AC voltage adjusted to a resonance frequency is applied to the primary winding 519*a*, a high voltage is required for generating a plasma discharge at the spark plug 19. For that reason, a voltage that is increased by the DC-DC converter 512 is applied to the spark plug 19 in a discharge time period during a compression stroke. However, in the case of generating streamer discharges, in which a low voltage is required to be applied to the spark plug 19, the configuration in which a voltage increased by the DC-DC converter 512 is applied to the spark plug 19 is unsuitable. Hence, if it is determined that the spark plug 19 is in a smoldering condition and the current combustion cycle of the engine 11 is an intake stroke, the configuration is changed such that the relay 521 is controlled to apply a voltage from the battery 511 to the ignition coil 519 via the switching section 514. As a result, since the voltage from the battery 511 becomes applied to the ignition coil 519 via the switching section 514, the control is appropriate for generating streamer discharges, which are weak discharges with a small secondary current.

Furthermore, to make the frequency of generation of the secondary current streamer discharges become higher than a predetermined frequency, threshold values are set for on duty ratios of the switching element 515A and the switching element 515B respectively, for each in-cylinder pressure. The respective on duty ratios of the switching element 515A and the switching element 515B are then controlled so as to be the minimum within a range that is greater than the set threshold value. Similar effects to those of the above embodiment are obtained by this configuration.

In the configuration described in the second other example, the relay 521 performs path switching of the current path 523 that applies the voltage increased by the DC-DC converter 512 to the primary winding 519*a* and of the current path 524 that applies voltage of the battery 511 to the primary winding 519*a*. However, instead of this, it would be equally possible to provide a high-voltage battery that supplies a higher voltage than that pf the battery 511, in place of the DC-DC converter 512.

In the above embodiment, it would be equally possible to use a known stroke discrimination for determining which stroke is the current stroke in the combustion cycle of the engine 11. For example, the stroke discrimination may be performed by using a crank angle signal from the crank angle sensor 33 and a cam angle signal from a cam angle sensor, which is not shown in the drawings.

If the streamer discharge generation control is applied to a multi-cylinder engine, determination of intake stroke may be performed based on an IGt signal transmitted to other cylinders. A method of determining intake stroke will be described with reference to FIG. 17.

Figure 17:
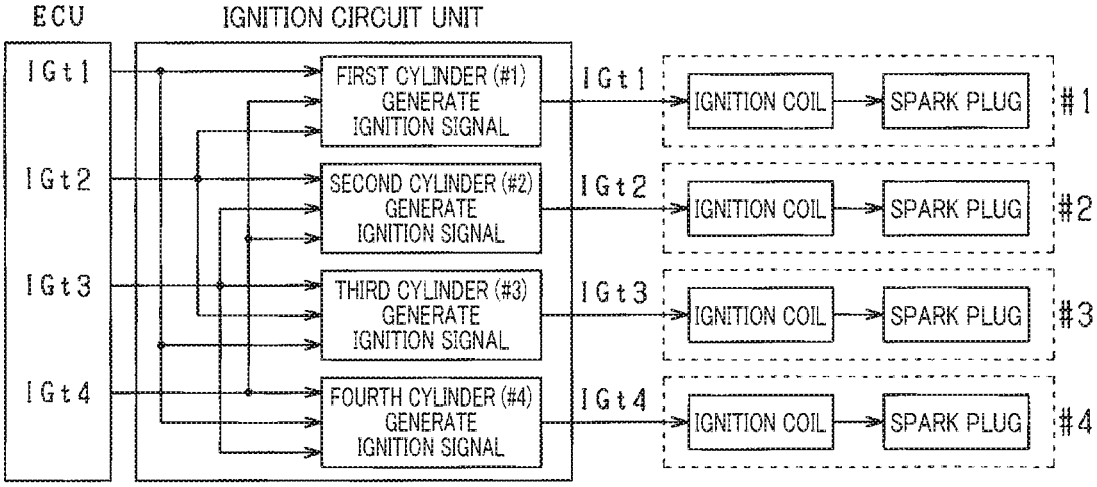
FIG. 17 is a diagram for describing a method of determining the cylinder that corresponds to the intake stroke in a current combustion cycle.
Figure 17:
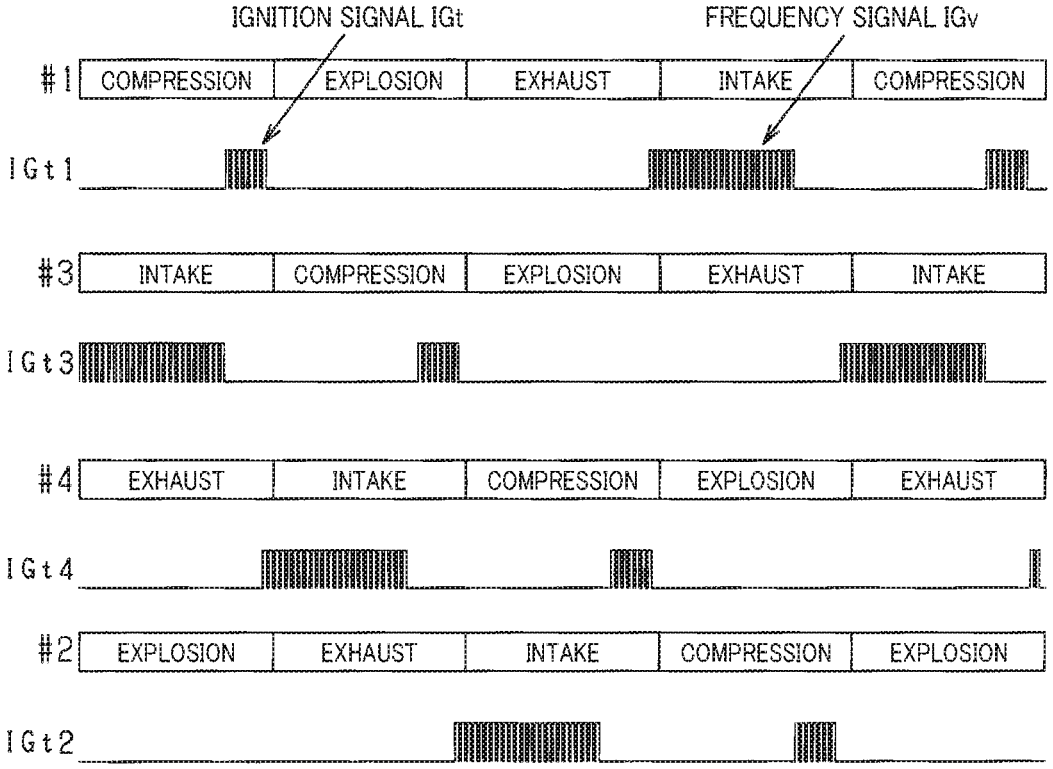

FIG. 17 shows an example in which the streamer discharge generation control is applied to a 4-cylinder engine. As shown in the lower part of FIG. 17, in the 4-cylinder engine, the control is applied such that the strokes of respective cylinders do not overlap with each other. That is, control is applied such that there is no time period in which strokes of the four cylinders overlap with each other, and such that each of the cylinders is in any of the four strokes constituting a combustion cycle, that is, an intake stroke, a compression stroke, an explosion stroke and an exhaust stroke.

Furthermore, as shown in the lower part of FIG. 17, the time period in which the plasma discharge is generated at the spark plug 19 for igniting the air-fuel mixture is at the end of the compression stroke.

From the above considerations, it can be understood that between the discharge termination time period during a compression stroke of one cylinder and the discharge start time period of a cylinder that performs the next compression stroke, during the same combustion cycle period, it is certain that another cylinder is approaching an intake stroke.

Specifically, during the interval from the termination timing of an ignition signal IGt1 that is transmitted for effecting ignition of fuel in the first cylinder until the start timing of transmitting the ignition signal IGt 3 to the third cylinder, the fourth cylinder is approaching an intake stroke. Similarly, during the interval from the termination of transmitting the ignition signal IGt 3 to the third cylinder until the start timing of transmitting the ignition signal IGt 4 to the fourth cylinder, the second cylinder is approaching an intake stroke. During the interval from the termination of transmitting the ignition signal IGt 4 to the fourth cylinder until the start timing of transmitting the ignition signal IGt 2 to the second cylinder, the first cylinder is approaching an intake stroke. During the interval from the termination of transmitting the ignition signal IGt 2 to the second cylinder until the start timing of transmitting the ignition signal IGt 1 to the first cylinder, the third cylinder is approaching an intake stroke.

Hence, as shown in the upper part of FIG. 17, the drive circuit provided for each cylinder, in addition to receiving an ignition signal for its own cylinder from the ECU, also receives ignition signals for other cylinders, as required for notification of the approximate start timing and approximate termination timing of an intake stroke of its own cylinder. Taking the first cylinder as an example, the timing of termination of receiving the ignition signal IGt 4 is determined to be the approximate start timing of an intake stroke of its own cylinder, and the timing of start of receiving the ignition signal IGt 2 is determined to be the approximate termination timing of an exhaust stroke of its own cylinder.

In the configuration of the present other example, it is possible to reduce the burden on the ECU of performing streamer discharge generation control, because it becomes unnecessary for the ECU to determine, for each of the cylinders, the stroke to which the current combustion cycle corresponds.

The intake stroke determination method of the present other example may be applied to the above embodiment and to various examples.

Although the present disclosure has been described in accordance with the embodiments, it is to be understood that the present disclosure is not limited to these embodiments and structures. The present disclosure encompasses various modifications and changes that are within an equivalent scope. Furthermore, various combinations and forms, and other combinations and forms that further include one or more or less elements also come within the scope and range of concepts of the present disclosure.

The invention claimed is:

1. An ignition control apparatus applied to an internal combustion engine that includes a spark plug, the spark plug being caused by an induced voltage to generate a plasma discharge for igniting a combustible mixture within a combustion chamber, the induced voltage being generated by switching on and off by a switching element included in a drive circuit, the ignition control apparatus comprising:

a processing system, including a processor for executing a process such that the ignition control apparatus is at least configured to perform:

an in-cylinder pressure acquisition which acquires a pressure within the combustion chamber as an in-cylinder pressure;

a frequency signal transmission which transmits a frequency signal to the switching element, the frequency signal causing switching on and off to be repetitively performed by the switching element at a predetermined frequency;

a weak discharge generation which causes the frequency signal transmission to transmit the frequency signal during an intake stroke and control the frequency signal such that a weak discharge, which has a secondary current which is lower than that of the plasma discharge, for igniting the combustible mixture is generated a plurality of times at the spark plug; and a control of the frequency signal such that a duty ratio, which is a ratio of a switched on time period to a sum of the switched on time period and a switched off time period of the switching element, is changed in accordance with the in-cylinder pressure that is acquired by the in-cylinder pressure acquisition, such that a frequency of generating the weak discharges at the spark plug during a time period in which the frequency signal is being transmitted becomes higher than a predetermined frequency.

2. The ignition control apparatus according to claim 1, wherein the ignition control apparatus is further configured to perform:

a control of the frequency signal such that the duty ratio is greater than a variation threshold value that is set for each cylinder pressure.

3. The ignition control apparatus according to claim 2, wherein the ignition control apparatus is further configured to perform:

a control of the frequency signal such that the duty ratio becomes a minimum value within a range greater than the variation threshold value.

4. The ignition control apparatus according to claim 1, wherein the ignition control apparatus is further configured to perform:

a control of the frequency signal such that the higher the in-cylinder pressure, the greater becomes the duty ratio.

5. The ignition control apparatus according to claim 1, wherein the ignition control apparatus is further configured to perform:

an ignition signal transmission that transmits an ignition signal which, after causing the switching element to conduct a primary current, causes the primary current to be blocked by the switching element, causing an induced voltage to be applied to the spark plug, the induced voltage generating an equilibrium plasma by the spark plug; and a multiple discharge execution which, in an environment in which combustion of fuel is difficult, causes the switching element to repetitively perform switching on and off by causing the ignition signal transmission to transmit the ignition signal a plurality of times, thereby causing multiple discharges to be executed, which cause an equilibrium plasma to be generated at the spark plug a plurality of times before igniting the combustible mixture during a compression stroke.

6. The ignition control apparatus according to claim 1, wherein the ignition control apparatus is further configured to perform:

a smoldering state determination which determines whether or not the spark plug is in a smoldering state, and wherein the weak discharge generation causes the spark plug to generate the weak discharge on condition that it is determined by the smoldering state determination that the spark plug is in a smoldering state.

7. The ignition control apparatus according to claim 1, wherein the ignition control apparatus is further configured to perform:

an ignition signal transmission that transmits an ignition signal which, after causing the switching element to conduct a primary current, causes the switching element to block the primary current, thereby causing an induced voltage to be applied to the spark plug that generates an equilibrium plasma by the spark plug;

a multiple discharge execution which causes the switching element to repetitively perform switching on and off by causing the ignition signal transmission to transmit the ignition signal a plurality of times, thereby causing multiple discharges to be generated which cause an equilibrium plasma to be generated by the spark plug a plurality of times, before igniting the combustible mixture during a compression stroke, in an environment in which combustion of fuel is difficult;

a smoldering state determination which determines whether or not the spark plug is in a smoldering state; and an air/fuel ratio determination which determines whether or not an air/fuel ratio of the combustible mixture supplied to the combustion chamber is rich, and wherein the weak discharge generation causes the spark plug to generate the weak discharge on condition that it is determined by the air/fuel ratio determination that the air/fuel ratio is rich, while it is determined by the smoldering state determination that the spark plug is not smoldering, and the multiple discharge execution causes the spark plug to generated the multiple discharges on condition that it is determined by the air/fuel ratio determination that the air/fuel ratio is rich, while it is determined by the smoldering state determination that the spark plug is smoldering.

8. The ignition control apparatus according to claim 1, wherein the ignition control apparatus is further configured to perform:

an ignition signal transmission that transmits an ignition signal which, after causing the switching element to conduct a primary current, causes the switching element to block the primary current, thereby causing an induced voltage to be applied to the spark plug, the induced voltage generating an equilibrium plasma by the spark plug;

a multiple discharge execution which causes the switching element to repetitively perform switching on and off, by causing the ignition signal transmission to transmit the ignition signal a plurality of times, thereby causing multiple discharges to be generated which cause an equilibrium plasma to be produced by the spark plug a plurality of times, before igniting the combustible mixture during a compression stroke, in an environment in which combustion of fuel is difficult;

a smoldering state determination which determines whether or not the spark plug is in a smoldering state; and an air/fuel ratio determination which determines whether or not an air/fuel ratio of the combustible mixture supplied to the combustion chamber is rich; and wherein the weak discharge generation causes the spark plug to generate the weak discharge on condition that it is determined by the air/fuel ratio determination that the air/fuel ratio is rich, and the multiple discharge execution causes the spark plug to generate the multiple discharges on condition that is determined by the air/fuel ratio determination that the air/fuel ratio is rich, while it is determined by the smoldering state determination that the spark plug is smoldering.

9. The ignition control apparatus according to claim 6, wherein the ignition control apparatus is further configured to perform:

a secondary voltage detection which detects a secondary voltage that is induced at the spark plug, and wherein if an absolute value of a first peak of the secondary voltage detected by the secondary voltage detection is greater than a predetermined voltage when the plasma discharge is generated for igniting the combustible mixture, the smoldering state determination determines that the spark plug is in a smoldering state.

10. The ignition control apparatus according to claim 1, wherein the ignition control apparatus is further configured to perform:

a control of the frequency of the frequency signal to a predetermined frequency at which streamer discharges are generated at the spark plug.

11. The ignition control apparatus according to claim 1, comprising:

a plurality of voltage supply which supply different power supply voltages to the switching element;

a first current path connected to the voltage supply which is included in the plurality of voltage supply and supplies a first voltage;

a second current path connected to the voltage supply which is included in the plurality of voltage supply and supplies a second voltage which is higher than the first voltage;

a third current path which is connected to the switching element; and a relay which performs changing between a first state in which the first current path is connected to the third current path and a second state in which the second current path is connected to the third current path, wherein during the intake stroke, the weak discharge generation causes the relay to perform changing from the second state to the first state and also causes the frequency signal transmission to transmit the frequency signal.

12. The ignition control apparatus according to claim 11, wherein when transmitting of the frequency signal by the frequency signal transmission is ended, the weak discharge generation causes the relay to perform changing from the first state to the second state.

* * * * *